US008544190B2

(12) United States Patent
Nishiwaki et al.

(10) Patent No.: US 8,544,190 B2
(45) **Date of Patent: *Oct. 1, 2013**

(54) SHOCK ABSORBING DEVICE FOR SHOE SOLE IN REAR FOOT PART

(75) Inventors: Tsuyoshi Nishiwaki, Kobe (JP); Shinji Senda, Kobe (JP)

(73) Assignee: ASICS Corporation, Hyogo (JP)

( * ) Notice: Subject to any disclaimer, the term of this patent is extended or adjusted under 35 U.S.C. 154(b) by 273 days.

This patent is subject to a terminal disclaimer.

(21) Appl. No.: 12/930,684

(22) Filed: Jan. 13, 2011

(65) Prior Publication Data

US 2011/0138651 A1 Jun. 16, 2011

Related U.S. Application Data

(63) Continuation of application No. 11/663,418, filed on Mar. 20, 2007, now Pat. No. 7,877,899.

(30) Foreign Application Priority Data

Sep. 30, 2004 (JP) ..... 2004-286578

(51) Int. Cl.
*A43B 13/18* (2006.01)

(52) U.S. Cl.
USPC ..... 36/28; 36/31; 36/114

(58) Field of Classification Search
USPC ..... 36/28, 25 R, 31, 30 R, 114, 35 R, 36/37, 142–144
See application file for complete search history.

(56) References Cited

U.S. PATENT DOCUMENTS 4,881,329 A * 11/1989 Crowley ..... 36/38
6,438,873 B1 * 8/2002 Gebhard et al. ..... 36/114

(Continued)

FOREIGN PATENT DOCUMENTS

DE 10112821 C1 8/2002
DE 10212862 C1 10/2003

(Continued)

OTHER PUBLICATIONS

Office Action dated Oct. 5, 2011, issued by the German Patent Office, In connection with corresponding German Patent Application No. 112005002327.3.

*Primary Examiner* — Marie Patterson
(74) *Attorney, Agent, or Firm* — Mintz Levin Cohn Ferris Glovsky and Popeo, P.C.

(57) ABSTRACT

The present invention provides a shock absorbing device for a shoe sole in a rear foot part which can restrain the inclination of the foot toward the medial side while absorbing the shock of landing on the lateral side of the foot. A shock absorbing device for a shoe sole in a rear foot part according to the present invention, includes: a support element M; deformation elements 3 disposed below the support element, the deformation elements deforming to be compressed vertically at landing; and outer sole elements 2 contacting a ground at landing, each outer sole element being joined to a bottom surface of the respective deformation element. Both the deformation elements 3 and the outer sole elements 2 are substantially separated in a medial-lateral direction in the rear foot part to be arranged at least three regions of the rear foot part. A quotient obtained by dividing an area of a bottom surface of the support element M by an area of bottom surfaces of the outer sole elements 2 is set at about 1.3 or more in the rear foot part. A vertical compressive stiffness of the deformation element 3 disposed on the lateral side is smaller than that of the deformation element 3 disposed on the medial side.

13 Claims, 23 Drawing Sheets

(56) References Cited

U.S. PATENT DOCUMENTS

| | | | | |
|---|---|---|---|---|
| 6,487,796 | B1 * | 12/2002 | Avar et al. | 36/28 |
| 6,568,102 | B1 | 5/2003 | Healy et al. | |
| 6,598,320 | B2 | 7/2003 | Turner et al. | |
| 6,694,642 | B2 | 2/2004 | Turner | |
| 6,722,058 | B2 | 4/2004 | Lucas et al. | |
| 6,789,332 | B1 * | 9/2004 | Scholz | 36/27 |
| 6,851,204 | B2 * | 2/2005 | Aveni et al. | 36/28 |
| 6,880,267 | B2 * | 4/2005 | Smaldone et al. | 36/28 |
| 6,898,870 | B1 * | 5/2005 | Rohde | 36/28 |
| 6,920,705 | B2 | 7/2005 | Lucas et al. | |
| 6,964,120 | B2 * | 11/2005 | Cartier et al. | 36/29 |
| 6,968,636 | B2 * | 11/2005 | Aveni et al. | 36/28 |
| 7,013,582 | B2 * | 3/2006 | Lucas et al. | 36/28 |
| 7,082,698 | B2 * | 8/2006 | Smaldone et al. | 36/28 |
| 7,441,346 | B2 * | 10/2008 | Hardy et al. | 36/25 R |
| 7,493,708 | B2 * | 2/2009 | Crowley, Jr. | 36/28 |
| 7,877,899 | B2 * | 2/2011 | Nishiwaki et al. | 36/28 |
| 2001/0027615 | A1 | 10/2001 | Nasako et al. | |
| 2003/0061731 | A1 | 4/2003 | Turner et al. | |
| 2003/0061732 | A1 | 4/2003 | Turner | |
| 2003/0226283 | A1 | 12/2003 | Braunschweller | |
| 2004/0148803 | A1 | 8/2004 | Grove et al. | |
| 2006/0137220 | A1 * | 6/2006 | Hardy et al. | 36/28 |
| 2007/0240331 | A1 * | 10/2007 | Borel | 36/28 |
| 2008/0034615 | A1 * | 2/2008 | Nishiwaki et al. | 36/88 |
| 2009/0013556 | A1 * | 1/2009 | Nishiwaki et al. | 36/28 |

FOREIGN PATENT DOCUMENTS

| | | |
|---|---|---|
| JP | 01-274705 | 11/1989 |
| JP | 02114905 | 4/1990 |
| JP | 05-56881 | 8/1993 |
| JP | 09-285304 | 11/1997 |
| JP | 2000-197503 | 7/2000 |
| JP | 2002-330801 | 11/2002 |
| WO | WO 97/46127 | 12/1997 |

* cited by examiner

SHOCK ABSORBING DEVICE FOR SHOE SOLE IN REAR FOOT PART

CROSS REFERENCES TO RELATED APPLICATIONS

This application is a continuation of U.S. patent application Ser. No. 11/663,418, filed on Mar. 20, 2007, now U.S. Pat. No. 7,877,899, which is incorporated herein by reference in its entirety. Priority to the aforementioned filing date is claimed.

TECHNICAL FIELD

The present invention relates to a shock absorbing device of a shoe sole in a rear foot part.

BACKGROUND ART

The cushioning function of absorbing and alleviating the shock at landing is demanded in shoe soles, in addition to the lightness in weight and the function of supporting the foot stably.

Generally, during running, a foot lands on the ground from a lateral side of a heel becomes and then inclines toward a medial side. Thus, the lateral side of the heel is subjected to large impact load of landing. Therefore, a rear foot part of the shoe sole can perform high cushioning function by deforming greatly on its lateral side. In addition, in order to restrain the inclination of the foot toward the medial side, the rear foot part of the shoe sole may be difficult to deform on its medial side, thereby performing high supporting function. Thus, it is preferred that the degree of the deformation of the shoe sole due to the shock differs between the medial side and the lateral side.

The shoe soles having an improved cushioning function are disclosed in the following patent documents.

First patent document: Japanese Patent Laid Open No. 09-285304 (abstract)

Second patent document: Japanese Patent Laid Open No. 2000-197503 (abstract)

Third patent document: Japanese Patent Laid Open No. 2002-330801 (abstract)

In the shoe soles of these documents, a member deforming due to the shock of landing is provided, and the shock of landing is absorbed by the deformation of the member. However, none of these documents discloses a point of preventing the inclination of the foot toward the medial side. And, since the deforming member is continuously provided from the medial side to the lateral side, it is difficult to adjust the difference of the degree of the deformation of the shoe sole due to the shock between the medial side and the lateral side. Thus, the shoe soles of these documents are difficult to exhibit both the shock absorption on the lateral side of the foot and the stability on the medial side of the foot.

A supported area of the deformation element divided in the rear foot part of the foot is small. Therefore, if the deformation element is made of resin foam such as EVA, a stress larger than its elastic proportional limit may be caused in the deformation element. In this case, the resin foam may undergo a great compression deformation, thereby impairing the supporting function. Permanent strain may be caused in the resin foam due to repeated stressing.

Recently, shoe soles having the repulsion function (rebound function) in addition to the above-mentioned functions have been presented. The repulsion function refers to the function of storing the impact energy at landing as deformation energy and emitting the energy of deformation when disengaging from the ground. This function is useful for improving exercise ability of a wearer.

By compressing or bending an element of the shoe sole, the deformation energy is stored in the element. However, when viscoelastic material having a small elastic proportional limit such as resin foam used for a cushioning member of the shoe sole is deformed, energy is dissipated as heat and so on. Accordingly, generally, such viscoelastic material cannot perform the repulsion function sufficiently.

The configurations of shoes having the above-mentioned repulsion function are disclosed in the following patent documents.

Fourth patent document: Japanese Patent Laid Open No. 01-274705 (abstract)

Fifth patent document: U.S. Pat. No. 6,598,320 (abstract)

Sixth patent document: U.S. Pat. No. 6,694,642 (abstract)

Seventh patent document: U.S. Pat. No. 6,568,102 (abstract)

In the shoe disclosed in Japanese Patent Laid Open No. 01-274705, a cavity is formed in the shoe sole. A reaction plate is built in this cavity. The reaction plate has upper and lower facing sides and fore and rear curved parts that connect the upper and lower facing sides. A gel cushioning member is provided in the reaction plate.

In this shoe sole, the gel cushioning member is not transversely separated nor longitudinally separated.

In the shoe sole disclosed in U.S. Pat. No. 6,694,642, hardness of the medial stabilizing pod is larger than that of the lateral stabilizing pod, but the outer sole of this shoe sole is not separated. In the shoe soles of U.S. Pat. No. 6,598,320 and U.S. Pat. No. 6,694,642, pod-like deformation elements are not arranged at three positions or more.

DISCLOSURE OF THE INVENTION

Therefore, an object of the present invention is to provide a shock absorbing device for a shoe sole in a rear foot part performing a high cushioning function and a high repulsion function by absorbing and storing the impact load of landing sufficiently while supporting the foot stably.

A shock absorbing device for a shoe sole in a rear foot part according to an aspect of the present invention, comprises: a support element that supports at least whole of a rear foot part of a foot, the support element having a function of absorbing a shock of landing by undergoing compression deformation due to the shock of landing; deformation elements disposed below the support element in the rear foot part, the deformation elements deforming to be compressed vertically at landing; and an outer sole contacting a ground at landing and having outer sole elements, each outer sole element being joined to a bottom surface of the respective deformation element, wherein both the deformation elements and the outer sole elements are substantially separated in a medial-lateral direction and/or a longitudinal direction in the rear foot part to be arranged at least three regions of the rear foot part, a height of each deformation element is set within a range of about 8 mm to about 50 mm, a quotient obtained by dividing an area of a bottom surface of the support element by an area of a bottom surface of the outer sole is set at about 1.3 or more in the rear foot part, each deformation element includes: a bending deformation member that undergoes bending deformation due to the shock of landing; and a compression deformation member that undergoes compression deformation due to the shock of landing to restrain the bending deformation of the bending deformation member, Young's modulus of a material forming the bending deformation member is larger than that of a material forming the support element, Young's modulus of a material forming the compression deformation member is smaller than that of the material forming the bending deformation member, and an elastic proportional limit with respect to a compressive load of the material forming the compression deformation member is larger than that of the material forming the support element.

In this aspect, the deformation elements are substantially separated in the rear foot part. Accordingly, a continuity of deformation between the regions of the rear foot part is broken.

A supported area of each deformation element discrete in the rear foot part of the foot is smaller than that of the support element. Therefore, great stress is generated in the deformation element. The shock of landing is received by the bending deformation member having large Young's modulus. The bending deformation member undergoes the bending deformation so that it can store larger energy than a case of compression deformation.

If the shock is absorbed only by the bending deformation, too much stress may be caused in a hinge portion of the bending deformation member, which raises the problem of endurance of the member. In view of this problem, the compression deformation member is provided so as to restrain too much bending of the bending deformation member.

Since the load is concentrated in the deformation member, great stress is caused therein. The elastic proportional limit of the compression deformation member is larger than that of the support element. Therefore, the compression deformation member is hard to undergo permanent deformation even when the shoe is repeatedly worn.

In this aspect, it is preferred that both the deformation elements and the outer sole elements are arranged at three to seven regions to be substantially separated in the rear foot part.

The deformation element may be provided at a fore foot part of the foot in addition to the rear foot part.

In the present invention, by the use of the term "join", it is meant to include both direct joining and indirect joining.

The compression deformation member may be, for example, a rubber-like or pod-like compression deformation member, and the rubber-like compression deformation member is more preferred.

The "rubber-like or pod-like compression deformation member" means a member that deforms so as to store a force of restitution (repulsion) while being compressed, and includes not only a member having rubber elasticity such as thermoplastic elastomer and vulcanized rubber but also a pod-like or bladder-like member in which air, a gelatinous material, a soft rubber-like elastic material or the like is filled. The "thermoplastic elastomer" means a polymer material that exhibits a property of vulcanized rubber at normal temperature and gets plasticized at high temperature to be molded with a plastic processing machine.

In the present invention, the rubber-like member, i.e., the member having rubber elasticity, means a member that is capable of great deformation (for example, rupture elongation thereof is more than 100%) and that is capable of recovering its original shape after the stress $\sigma$ (sigma) is removed. In this member, as shown in a solid line L1 of the stress-strain diagram of FIG. 23, generally, as the strain $\delta$ (delta) gets greater, the amount of change of the stress $\sigma$ with respect to the amount of change of the strain $\delta$ becomes larger.

Accordingly, generally, as shown in a broken line L2 of the FIG. 23, a material in which, when a stress $\sigma$ is above a certain extent, the strain $\delta$ increases with little increase of the stress $\sigma$ (for example, resin foam) is not the member having the rubber elasticity.

As shown in FIG. 23, an elastic proportional limit $\sigma_F$ of such resin form is smaller than an elastic proportional limit $\sigma_G$ of the rubber-like member. Accordingly, such resin foam might cause unstable support of the foot when a localized load is applied.

Note that the "elastic proportional limit" means a maximum stress in the range where the relationship between the change of the compression load applied to the compression deformation member and the change of the amount of the compression of this member is proportional, i.e., where the change of the strain is proportional to the change of the compression stress.

In the present invention, the support element supports substantially the whole of the rear foot part, and, generally, is formed of resin foam. The support element may be formed of any material as long as the support element can disperse the shock transferred from the deformation element, and therefore may be formed of, for example, non-foam of soft resin.

In the present invention, Young's modulus of the support element or Young's modulus of the compression deformation member is smaller than that of the bending deformation member. Here, "Young's modulus" means a ratio of the stress to the strain in the beginning $P_I$ of the deformation of the material, as shown in FIG. 23.

The bending deformation member may be a member having a circular, oval, U-shaped or V-shaped cross section or a coil spring. The coil-spring is a member undergoing bending deformation continuous along its spiral.

In the case where the compression deformation member is formed of a rubber-like material, it is preferred that Young's modulus of the rubber-like material is set within a range of about 0.1 kgf/mm$^2$ to about 5.0 kgf/mm$^2$, and Young's modulus of the material forming the bending deformation member is set within a range of about 1.0 kgf/mm$^2$ to about 30 kgf/mm$^2$.

In this aspect, it is preferred that the shock absorbing device further comprises a connecting member that is interposed between the support element and the deformation elements, the connecting member being joined to the bottom surface of the support element and joined to an upper surface of each deformation element. Young's modulus of a material forming the connecting member is larger than that of the material forming the support element.

In this case, the shock of landing is dispersed by the hard connecting member. Therefore, the sole of the foot is less subjected to a localized shock. Thus, it can produce a soft sensation on the sole of the foot.

It is more preferred that Young's modulus of the material forming the connecting member is set smaller than that of the bending deformation member. Such setting can produce a softer sensation on the sole of the foot.

Further, it is preferred that the support element includes a first roll-up portion rolling upwards along a side face from a bottom face of the foot, and the connecting member includes a second roll-up portion rolling upwards outside the first roll-up portion of the support element.

Such roll-up portions enables the foot to be supported at the periphery of the support element. Therefore, a stable support of the foot can be expected.

Further, it is more preferred that, in addition to the first and second roll-up portions, the bending deformation member includes a third roll-up portion rolling upwards outside the first roll-up portion of the support element. By providing such roll-up portions, a more stable support of the foot can be expected.

Another object of the present invention is to provide a shock absorbing device for a shoe sole in a rear foot part which can restrain the inclination of the foot toward the medial side while absorbing the shock of landing on the lateral side of the foot.

A shock absorbing device for a shoe sole in a rear foot part according to another aspect of the present invention comprises: a support element that supports at least whole of a rear foot part of a foot, the support element having a function of absorbing a shock of landing; deformation elements disposed below the support element in the rear foot part, the deformation elements deforming to be compressed vertically at landing; and an outer sole contacting a ground at landing and having outer sole elements, each outer sole element being joined to a bottom surface of the respective deformation element, wherein both the deformation elements and the outer sole elements are substantially separated at least in a medial-lateral direction in the rear foot part to be arranged at least three regions of the rear foot part, a height of each deformation element is set at about 8 mm or more, a quotient obtained by dividing an area of a bottom surface of the support element by an area of a bottom surface of the outer sole is set at about 1.3 or more in the rear foot part, a vertical compressive stiffness of the deformation element disposed on a lateral side of the rear foot part is smaller than that of the deformation element disposed on a medial side of the rear foot part.

In this aspect, since the deformation elements are substantially separated at least in a medial-lateral direction in the rear foot part, a continuity of deformation between the medial-lateral sides is broken.

Furthermore, the compressive stiffness of the deformation element disposed on the lateral side is smaller than that of the deformation element disposed on the medial side. Therefore, the shock absorbing property at landing can be improved by deforming greatly the deformation element on the lateral side. In addition, the deformation of the deformation element on the medial side becomes smaller, and so the inclination of the foot toward the medial side can be restrained, thereby supporting the foot stably.

Furthermore, since the deformation elements are substantially separated in the rear foot part to be arranged at least three regions and the area of the bottom surface of the outer sole is smaller than the area of the bottom surface of the support element, the weight saving of the shoe sole can be enhanced. Note that, in the present invention, the term "the area of bottom surface of the support element" means a projected area of the support element viewed from the bottom side, and that the term "the area of bottom surface of the outer sole" means a projected area of the outer sole viewed from the bottom side. In view of the weight saving and the stability of the shoe sole, it is preferred that the deformation elements are arranged at three to seven regions in the rear foot part, and it is most preferred that the deformation elements are arranged at three to five regions.

In the present invention, the term "the deformation elements and the outer sole elements are substantially separated in the rear foot part" means that a continuity of deformation between regions of the rear foot part is substantially broken or extremely small, and the term includes a case where a plurality of the deformation elements are separately made and arranged spaced apart from each other and a case where only either of the bending deformation members and the compression deformation members constituting the deformation elements are physically separated.

In this aspect, the quotient obtained by dividing the area of the bottom surface of the support element by the area of the bottom surface of the outer sole is set at about 1.3 or more in the rear foot part. This quotient is more preferably set at about 1.5 or more, and, most preferably set at about 1.7 or more. In the present invention, the term "the rear foot part of the foot" means a portion of the foot in the rear of the arch (plantar arch) of the foot and this portion includes a portion covering a calcaneal bone of the foot.

Since the deformation element has a height of about 8 mm or more, the deformation element can compress sufficiently due to the shock of landing, it can perform sufficient cushioning function. In view of the shock absorbing property and the stability, the height of the deformation element is preferably set at about 8 to 25 mm, and most preferably set at about 10 to 20 mm.

In this aspect, it is preferred that the deformation elements are provided depending on the number of the regions and an average of vertical compressive stiffness per unit area of the deformation elements disposed on the lateral side of the rear foot part is smaller than that of the deformation elements disposed on the medial side of the rear foot part.

In a case of such shock absorbing device for the shoe sole, it becomes possible to form the medial and lateral deformation elements independently and to make easily the compressive stiffness of the medial deformation element different from that of the lateral deformation element.

In the present invention, the term "the vertical compressive stiffness per unit area of the deformation element" means a value obtained by dividing a vertical load necessary for a predetermined amount (for example, 1 mm) of vertical compression of the deformation element by an area of a bottom surface of the deformation element. Note that the vertical compression is not limited to compression deformation and includes various deformations, such as bending deformation and shearing deformation.

In this aspect, it is preferred that the device further comprises a connecting member that is interposed between the support element and the deformation elements, the connecting member being joined to the bottom surface of the support element and joined to an upper surface of each deformation element, wherein Young's modulus of a material forming the connecting member is larger than that of a material forming the support element.

In the preferred embodiment of this aspect, each deformation element is like a small block while the support element is like a thin plate. In a case where the block-like deformation elements are directly joined to the plate-like support element, a junction between the support element may be weakened or upthrust feeling may occur on the sole of the foot. In view of this, the deformation element and the support element are indirectly joined via the hard connecting member, which enhances the strength of the junction. In addition, the hard connecting member enables the shock applied onto the deformation elements to be transferred dispersedly to the support element.

In this case, it is preferred that the support element includes a first roll-up portion rolling upwards along a side face from a bottom face of the foot, and the connecting member includes a second roll-up portion rolling upwards outside the first roll-up portion of the support element.

Since the support element and the connecting member include the first and second roll-up portions, respectively, the stability can be greatly improved. The deformation elements are not provided on the whole of the rear foot part, and so they cannot support continuously the whole circumference of the support element. In view of this, the hard connecting member is rolling upwards outside the first roll-up portion to constitute the second roll-up portion, and the first roll-up portion of the support element is sufficiently supported. Thus, the foot can be stably supported, even if the support by the deformation elements is discontinuous.

In this aspect, it is preferred that the support element includes a first roll-up portion rolling upwards along a side face from a bottom face of the foot, each deformation element includes a material having larger Young's modulus than the material forming the support element, and the material having the larger Young's modulus constitute a third roll-up portion rolling upwards outside the first roll-up portion of the support element.

In this case, the hard material of the deformation element forms the third roll-up portion and the third roll-up portion is rolling upwards outside the first roll-up portions of the support element. Therefore, even if the connecting member is not provided, the effect of the above first and second roll-up portions can be obtained.

In this aspect, it is preferred that, in at least one of the regions, the deformation element is more difficult to compress vertically in medial and lateral side portions than in a central portion in the medial-lateral direction.

If the deformation elements are easy to compress in the medial and lateral side portions, adduction or abduction of the foot may be easily caused. However, above setting of the deformation elements prevents such a problem, which leads to the stability of the foot.

DESCRIPTION OF REFERENCE NUMERALS

Figure 1:
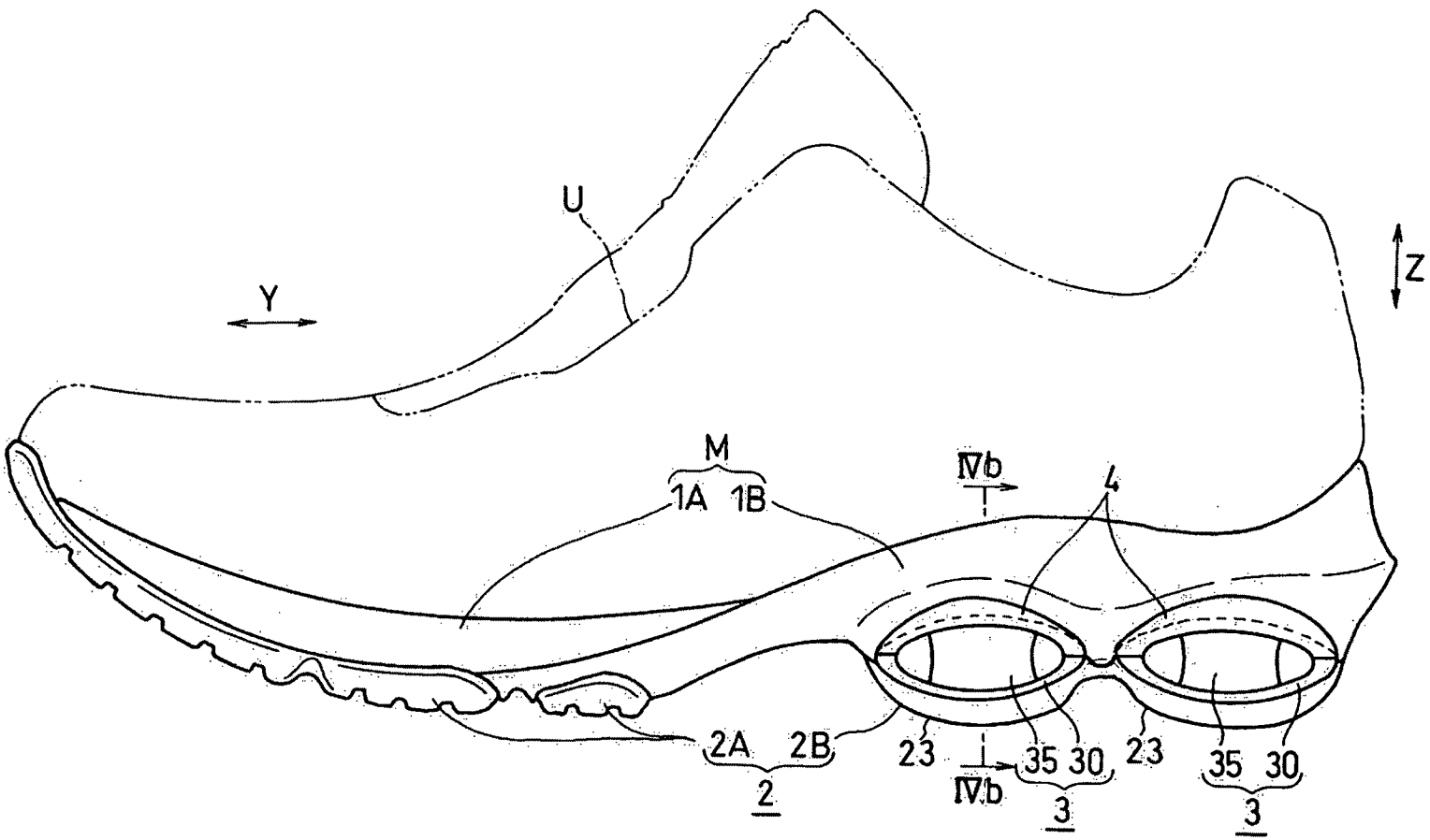
FIG. 1 is a side view of a shoe according to a first embodiment of the present invention.

19, 119: First roll-up portion
2: Outer sole
3: Deformation element
39, 139: Third roll-up portion (another roll-up portion)
4: Connecting member
49, 149: Second roll-up portion
301: First deformation element
302: Second deformation element
303: Third deformation element
2*a*: Ground contact surface
30A: Bending deformation member
131: Lower plate portion
131*a*: First lower area
131*b*: Second lower area
132: Upper plate portion
132*a*: First upper area
132*b*: Second upper area
133: Hinge portion
135: Rubber-like member (compression deformation member)
137: Notch
138: First reinforcing part
142: Second reinforcing part
151, 152: Opposed surface
Sr: Minor axis
M: Midsole (support element)
X: Medial-lateral direction
Y: Longitudinal direction
Z: Vertical direction
θ1: First opening angle
θ2: Second opening angle

BEST MODE FOR CARRYING OUT THE INVENTION

The present invention will be understood more apparently from the following description of preferred embodiment when taken in conjunction with the accompanying drawings. However, it will be appreciated that the embodiments and the drawings are given for the purpose of mere illustration and explanation and should not be utilized to define the scope of the present invention. The scope of the present invention is to be defined only by the appended claims. In the drawings annexed, the same reference numerals denote the same or corresponding parts throughout several views.

Embodiments of the present invention will now be described with reference to the drawings.

First Embodiment

FIGS. 1 to 4 show the first embodiment of the present invention.

As shown in FIG. 1, a shoe sole of this embodiment includes a midsole (an example of a support element) M, an outer sole 2 and deformation elements 3. The midsole M is formed by vertically bonding a first midsole body 1A which is arranged in an upside and a second midsole body 1B which is arranged in a downside. The outer sole 2, a so-called shank (not shown) etc. are disposed on bottom surfaces of the midsole bodies 1A, 1B. An insole (not shown) is bonded onto the first midsole body 1A. Each midsole body 1A, 1B is, for example, formed of a material suitable for shock absorption, such as resin foam of EVA (ethylene-vinyl acetate copolymer), polyurethane or the like. Above the midsole M and the insole, an upper U that is suitable for covering the instep of the foot is disposed. The outer sole 2 that gets contact with the ground surface or the floor surface at the time of landing is formed of a material having a higher abrasion resistance than the midsole material.

Figure 2:
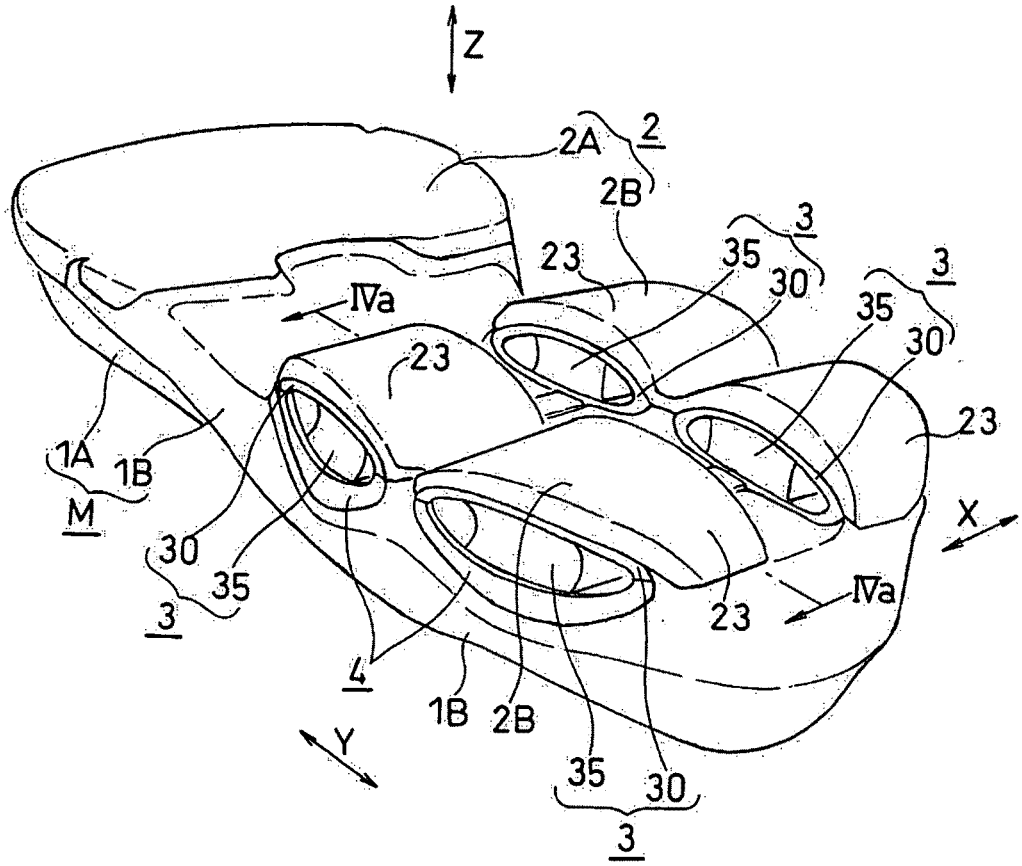
FIG. 2 is a perspective view of the same shoe viewed from the bottom side of the shoe sole.

FIG. 2 is a perspective view of the shoe sole of the present embodiment, viewed from its bottom surface side.

As shown in FIG. 2, the outer sole 2 includes a first outer sole 2A provided at a fore foot part of the foot and the second outer sole 2B provided at a rear foot part of the foot. Deformation elements 3 and a connecting member 4 for retaining the deformation elements 3 are interposed between the second outer sole 2B and the second midsole body 1B.

As shown in FIG. 2, four deformation elements 3 are provided in the shoe sole; two of them are disposed on a medial side of the rear foot part of the foot, and the remaining two of them are disposed on a lateral side of the rear foot part of the foot. That is, the deformation elements 3 are arranged in two rows located on the medial and lateral side of the rear foot part, with two deformation elements disposed in each row, so that the deformation elements are spaced apart from each other in the medial-lateral direction X of the foot and in the longitudinal direction Y.

The second outer sole 2B are divided into the medial side and the lateral side, the medial and lateral sides of the second outer soles 2B are spaced apart from each other in the medial-lateral direction X, and each side of the second outer soles 2B is arranged so as to cover, from below, the two deformation elements 3, 3 aligned along the longitudinal direction Y on the respective side.

Figure 3:
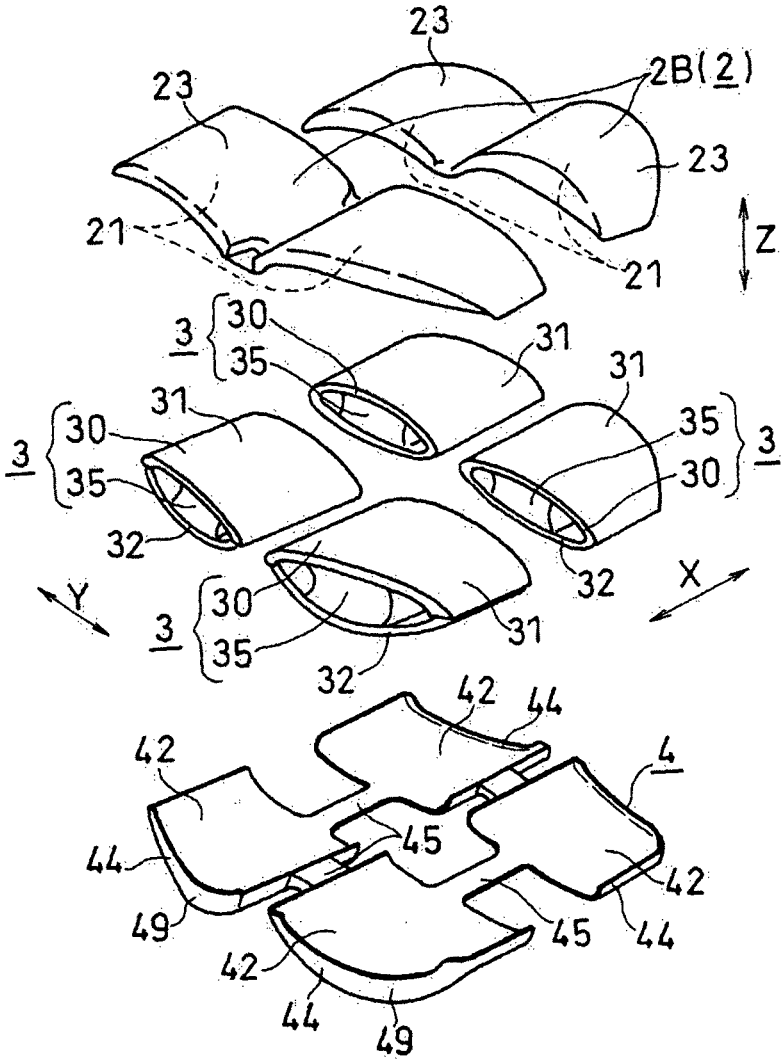
FIG. 3 is an exploded perspective view of an outer sole, deformation elements and a connecting member viewed from the bottom side.

FIG. 3 is a exploded perspective view of the second outer sole 2B, the deformation elements 3 and the connecting member 4 of FIG. 2, viewed from the bottom surface side.

As shown in FIG. 3, the upper surface of the second outer sole 2B is adhesive bonded to a lower portion 31 of the deformation element 3 (upper half of the deformation element 3 in FIG. 3). The upper portion 32 of the deformation element 3 (lower half of the deformation element 3 in FIG. 3) is adhesive bonded or fusion bonded to the connecting member 4, and the connecting member 4 is adhesive bonded to the bottom surface of the second midsole body 1B (FIG. 2). That is, the upper portion 32 of the deformation element 3 is joined to the bottom surface of the second midsole body 1B via the connecting member 4.

Deformation Element 3:

As shown in FIG. 3, the deformation element 3 includes a tubular part 30 and a cushioning member (compression deformation member) 35 provided in an internal space of the tubular part 30. Young's modulus of the cushioning member 35 is smaller than that of the tubular part 30. A material forming the cushioning member 35 may be, for example, a rubber-like member or foam of EVA. This rubber-like member may be a gel (commercial name for cushioning member), and so, hereinafter, the cushioning member is referred to as "gel" in the first to fourth embodiments. Since load is concentrated on the deformation element, great stress is generated therein. Therefore, it is preferred that the elastic proportional limit of the compression deformation member is larger than that of the midsole M. It makes this compression deformation member less likely to be subjected to permanent deformation even if the shoe is worn over and over again. In a case where a material forming the cushioning member 35 is gel, it is preferred that Young's modulus of the gel is about 0.1 $kgf/mm^2$ to about 1.0 $kgf/mm^2$. In this embodiment, the cushioning member 35 is arranged so as to be contact with the upper portion 32 and the lower portion 31 approximately at the longitudinal center of the internal space of the tubular part 30.

The tubular part 30 is formed of a material having Young's modulus greater than Young's modulus of the material forming the midsole M and Young's modulus of the material forming the outer sole 2. The Young's modulus of the material forming the tubular part 30 is 1.0 $kgf/mm^2$ to 30 $kgf/mm^2$, and, more preferably, it is 2.0 $kgf/mm^2$ to 10 $kgf/mm^2$. The material forming the tubular part 30 may be, for example, non-foam resin such as nylon, polyurethane and FRP.

Young's modulus of the materials forming the tubular part 30 and the cushioning member 35 may differ from the medial side of the rear foot part to the lateral side of the rear foot part. A thickness of the tubular part 30 and a section area of plane section of the cushioning member 35 may differ from the medial side of the rear foot part to the lateral side of the rear foot part. Such setting makes a vertical compressive stiffness per unit area of the deformation element 3 on the lateral side of the rear foot part less than that of the deformation element 3 on the medial side of the rear foot part, thereby preventing an excessive pronation of the foot.

Figure 4A:
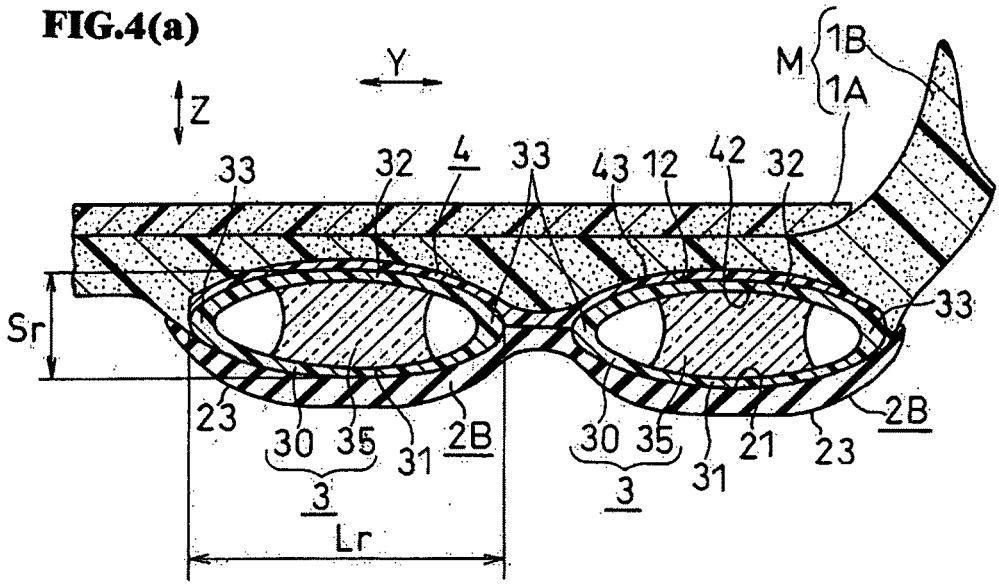
FIG. 4(*a*) is a view obtained by rotating by 180 degrees a sectional view taken along the line IVa-IVa of FIG. 2 and FIG. 4(*b*) is a sectional view taken along the line IVb-IVb of FIG. 1.
Figure 4B:
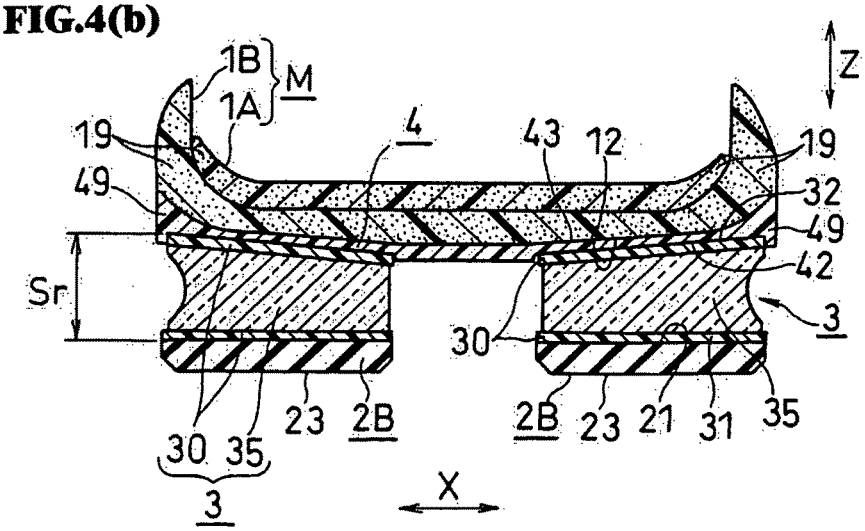

FIG. 4(*a*) is a longitudinal sectional view of the shoe sole which view is obtained by rotating by 180 degrees a sectional view taken along the line IVa-IVa of FIG. 2 so that the shoe sole is illustrated in accordance with usual top and bottom orientation. FIG. 4(*b*) is a transverse sectional view taken along the line IVb-IVb of FIG. 1.

As shown in FIG. 4(*a*), the tubular part 30 is integrally formed to be seamless in the longitudinal section of the shoe sole. The tubular part 30 is flattened to be of substantially oval or elliptical shape having a major axis Lr along the longitudinal direction Y of the foot and a minor axis Sr along the vertical direction Z. That is, the tubular part 30 includes: the lower portion 31 that is curved along the longitudinal direction Y so as to be convex downwards; and the upper portion 32 that is curved along the longitudinal direction Y so as to be convex upwards. The lower portion 31 and the upper portion 32 undergo bending deformation due to impact load of landing, because of their curved shape. This deformation makes the deformation element 3 compressed in the vertical direction. The detail of the bending deformation of the lower portion 31 of the tubular part 30 due to the impact load of landing will be described later.

The length of the major axis Lr is set within a range of about 25 mm to about 80 mm. The length of the minor axis Sr is set within a range of about 8 mm to about 25 mm. Note that the length of the minor axis Sr means the height of the deformation element. Flatness (Lr/Sr) obtained by dividing the length of the major axis Lr by the length of the minor axis Sr of the tubular part is set within a range of about 1.5 to about 4.0.

As shown in FIG. 4(*b*), the minor axis Sr of the tubular part 30 becomes shorter as it gets closer to a center in the medial-lateral direction of the foot. Similarly, the major axis Lr of the tubular part 30 becomes shorter as it gets closer to the center in the medial-lateral direction of the foot.

As shown in FIG. 4(*a*), end portions 33 are provided, respectively, in front of and in the rear of the lower portion 31 of the tubular part 30. A thickness of each end portion 33 is greater than both that of the upper portion 32 and that of the lower portion 31. The thickness of the end portion 33 is set within a range of about 1.5 mm to about 8.0 mm, and the thickness of the lower portion 31 and the thickness of the upper portion 32 are, each, set within a range of about 1.0 mm to about 4.0 mm.

Connecting Member 4:

As shown in FIG. 4(*a*), a lower curved surface 42, which is concave along the upper portion 32 of the tubular part 30, is provided on a lower surface of the connecting member 4, and the upper portion 32 of the tubular part 30 fits into the lower curved surface 42. A concave second curved surface 12 is provided on the bottom surface of the second midsole body 1B. An upper curved surface 43, which is curved to be convex upwards along the second curved surface 12, is provided on an upper surface of the connecting member 4. This upper curved surface 43 of the connecting member 4 fits into the second curved surface 12 of the second midsole body 1B.

Accordingly, the upper portion 32 of the tubular part 30 fits into the second curved surface 12 of the second midsole body 1B via the connecting member 4.

As shown in FIG. 3, in this embodiment, four retaining part 44 are provided on one connecting member 4, and the retaining parts 44 are connected with each other by connection bars 45. The lower curved surface 42 into which the upper portion 32 of the tubular part 30 fits is provided on each retaining part 44. Accordingly, a plurality of tubular parts 30 can easily be joined to the second midsole body 1B (FIG. 2), by joining the plurality of tubular parts 30 to the lower curved surface 42 of each retaining part 44 of the connecting member 4 and then joining the connecting member 4 to the second midsole body 1B. Furthermore, adhesiveness of the tubular part 30 is improved by joining the upper portion 32 of the tubular part 30 to the connecting member 4. That is the tubular part 30 will be less likely to drop off from the shoe sole.

Young's modulus of the connecting member 4 is set larger than that of the midsole M. Since the connecting member 4 having such large Young's modulus retains the tubular part 30, the midsole M becomes less likely to suffer a high localized load at the time of landing and a part of the midsole M where the tubular part 30 is joined is less likely to be damaged, as compared to a case where the tubular part 30 is directly joined to the midsole M.

As shown in FIG. 4(*b*), the first and second midsole bodies 1A, 1B have a first roll-up portion 19 rolling upwards along the side face from the sole of the foot. The connecting member 4 has a second roll-up portion 49 rolling upwards outside the first roll-up portion 19. That is, the second roll-up portion 49 rolling upwards is provided on both ends of the medial-lateral direction of the connecting member 4. Since the connecting member 4 of harder material is rolling upwards outside the first roll-up portion 19 of the midsole M, the first roll-up portion 19 is sufficiently supported and therefore the foot can be stably supported.

Second Outer Sole 2B:

As shown in FIG. 4(*a*), below the tubular part 30, the second outer sole 2B is curved along the lower portion 31 of the tubular part. A concave first curved surface 21 is provided on the upper surface of the second outer sole 2B. The lower portion 31 of the tubular part 30 is fit into the first curved surface 21 without clearance. A third curved surface 23 is provided on the ground contact surface of the second outer sole 2B and the third curved surface is curved to be convex downwards along the lower portion 31 of the tubular part 30. As shown in FIG. 3, the second outer sole 2B is separated into two in the medial-lateral direction, each covering the lower portions 31, 31 of a pair of the tubular parts 30, 30 aligned along the longitudinal direction Y.

As shown in FIG. 4(*a*), the upper portion 32 of the tubular part 30 is fit into the second midsole body 1B via the connecting member 4, and substantially whole of the lower portion 31 of the tubular part 30 protrudes (bulges) downwards further than the second midsole body 1B. Substantially whole of the lower portion 31 of the tubular part 30 is covered with the second outer sole 2B. The second outer sole 2B is joined to the second midsole body 1B in the vicinity of the front and rear end portions of the connecting member 4.

In the rear foot part of the foot, an area of the bottom surface of the midsole body 1B divided by an area of the bottom surface of the second outer sole 2B is 1.3 or more. That is, an area of the bottom surface of a part of the midsole M in the rear of the arch divided by the area of the bottom surface of the second outer sole 2B is 1.3 or more.

As shown in FIG. 4(*a*), the lower portion 31 and the upper portion 32 of each tubular part 30 is connected via the front and rear end portions 33, 33, and these end portions 33 can be a center of deformation during the bending deformation of the lower portion 31 and the upper portion 32. Among these end portions 33, two end portions 33, 33 are located on a near side where the pair of the tubular parts 30, 30 face each other, the upper part of these two end portions 33, 33 is covered with the connecting member 4 and the lower part thereof is cover with the second outer sole 2B. The other end portions 33, 33 are located on a far side which is opposite to the near side, the upper part thereof is covered with the connecting member 4, and the terminal part thereof is covered with the second midsole body 1B, which extends around from the upper part to the lower part of the end portion 33. In addition, the terminal part of the end portions 33 is also covered with the second outer sole 2B from the outside of the second midsole body 1B. Thus, the external surfaces of the end portions 33 of the tubular part 30 are covered with the second midsole body 1B and/or the second outer sole 2B.

Since the end portions 33 of the tubular part 30 are covered with another member, the end portions 33, which is subjected to large load every time the tubular part 30 undergoes the bending deformation, can be protected from the strength reduction due to aging deterioration of by light and the like, the endurance of the end portions.

Deformation of the Shoe Sole During the Period from Landing on the Ground to Disengaging from the Ground:

Next, a test on deformation of the shoe sole in the case where the user, wearing the shoe sole of the first embodiment, makes a series of motions from landing on the ground to disengaging from the ground will be described. In this test, the Young's modulus of the tubular part 30 was set at 5 $kgf/mm^2$. A gel was used as the shock absorbing member, and the Young's modulus of a gel 35 on the lateral side of the foot and that of a gel 35 on the medial side of the foot were set at 0.2 kgf/mm$^2$ and 0.3 kgf/mm$^2$, respectively.

Figures 11A, 11B, 11C, 11D, 11E:
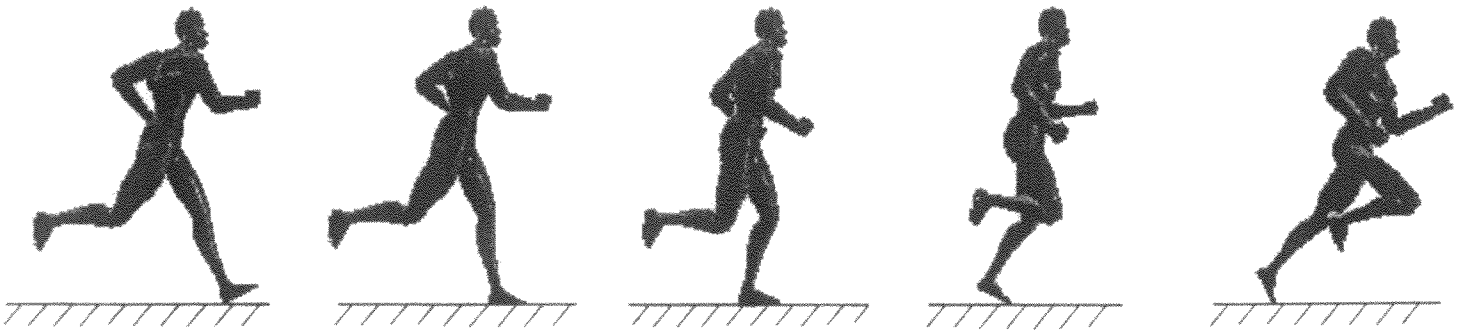
FIGS. 11(*a*) to 11(*e*) are schematic side views showing behavior of a body from landing on the ground to disengaging from the ground during running.

First, a motion of the foot during running will be described. FIGS. 11(*a*) to 11(*e*) are schematic side views showing a series of motions of a body from landing on the ground to disengaging from the ground during running. FIG. 11(*a*) shows the state where the foot firstly lands on the ground, i.e., the rear end of the heel gets contact with the ground (so-called "heel-contact"), FIG. 11(*b*) shows the state where substantially the whole of the sole of the foot is in contact with the ground (so-called "foot-flat"), FIG. 11(*c*) shows the state immediately before the foot starts to kick (so-called "mid-stance"), FIG. 11(*d*) shows the state where the foot kicks the ground with the heel lifted (so-called "heel-rise") and the FIG. 11(*e*) shows the state immediately before the toe disengages from the ground (so-called "toe-off"). As shown in these figures, the foot lands on the ground from the rear end of the heel, the whole of the sole gradually contacts the ground, and then, the fore foot part kicks the ground to disengage from the ground.

Figures 12A, 12B, 12C, 12D, 12E:
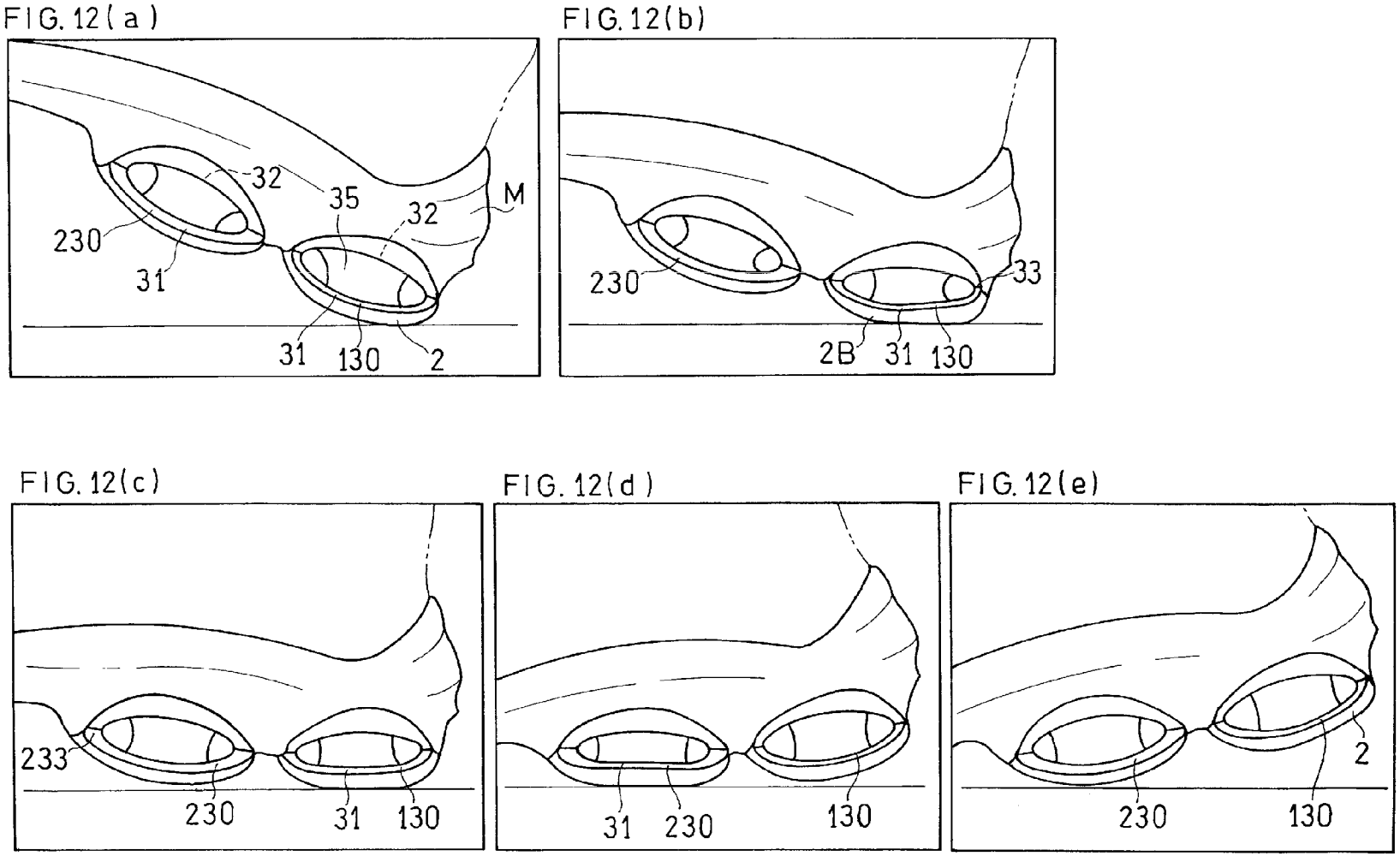
FIGS. 12(*a*) to 12(*e*) are partial lateral side views showing deformation of a rear foot part of the shoe sole according to the first embodiment during landing.
Figure 13A:
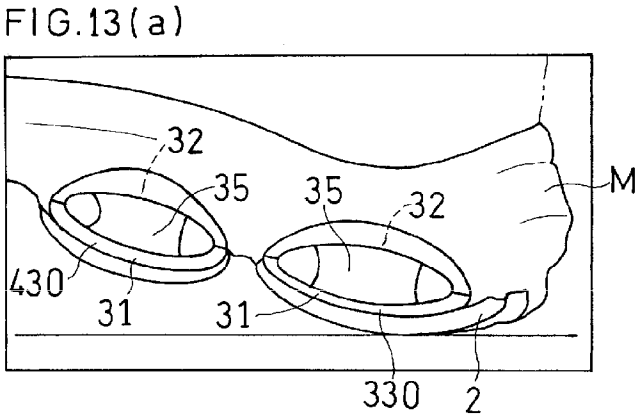
FIGS. 13(*a*) to 13(*d*) are partial medial sectional views showing the deformation of the rear foot part of the shoe sole.
Figure 13B:
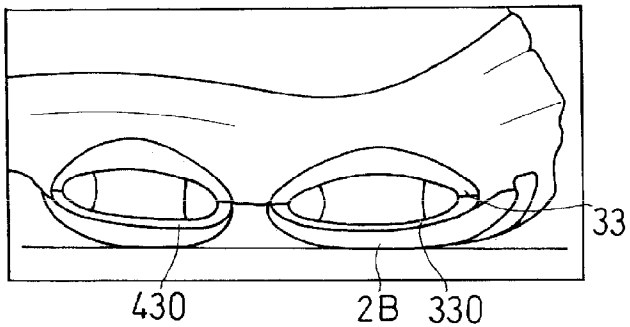
Figure 13C:
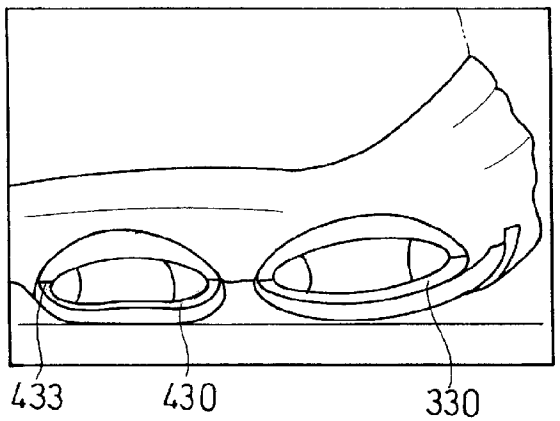
Figure 13D:
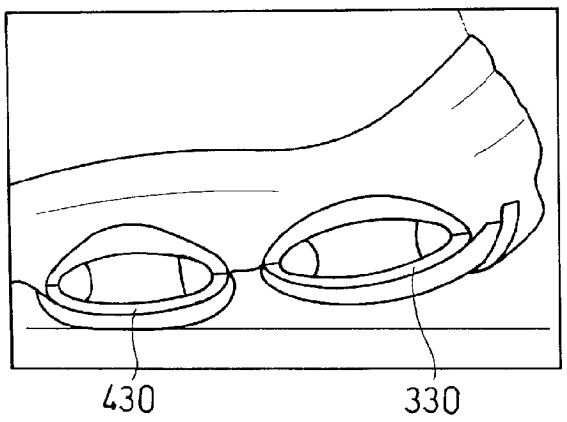

FIGS. 12 (*a*) to 12(*e*) are lateral side views showing deformation of the lateral side of the rear foot part of the shoe sole of the first embodiment during landing.

FIG. 12(*a*) shows the state of the shoe sole at the time of the "heel-contact". In this state, the outer sole 2 on the lateral side of the rear foot part firstly lands on the ground and the rear part of the lower portion 31 of the tubular part 130 in the rear of the lateral side of the rear foot part performs a little bending deformation. As shown in FIGS. 12(*b*) and 12(*c*), the lower portion 31 of the tubular part 130 in the rear of the lateral side of the foot performs large bending deformation during the period from the "heel-contact" to the "foot-flat", and therefore, the tubular part 130 compresses in the vertical direction. Subsequently, at the time of the "foot-flat", as shown in FIG. 12(*d*), the lower portion 31 of the tubular part 230 in the fore of the lateral side of the rear foot part performs large bending deformation, and therefore, the tubular part 230 compresses in the vertical direction. At the time of the "mid-stance", the outer sole 2 below the tubular parts 130, 230 gradually disengage from the ground. Then, at the time of the "heel-rise", as shown in FIG. 12(*e*), the outer sole 2 completely disengages from the ground and both the tubular parts 130, 230 returns to the respective original shape.

FIGS. 13(*a*) to 13(*d*) are medial side views showing deformation of the medial side of the rear foot part of the shoe sole of the first embodiment during landing.

FIG. 13(*a*) shows the state of the shoe sole at the time of the "heel-contact". In this state, the medial side of the shoe sole is out of contact with the ground and the tubular parts 330, 430 on the medial side are undeformed in appearance. Subsequently, during the period from the "foot-flat" to the "mid-stance", as shown in FIG. 13(*b*), both of the tubular parts 330, 430 on the medial side of the rear foot part perform bending deformation, thereby compressing in the vertical direction. Next, as shown in FIG. 13(*c*), bending deformation of the tubular part 430 in the fore of the medial side of the rear foot part is further increased. At the time of the "heel-rise", as shown in FIG. 13(*d*), the tubular part 430 in the fore of the medial side of the rear foot part starts to return to the original shape and at the time of the "toe-off" when the heel is completely lifted, the outer sole 2 of the rear foot part disengages from the ground and the tubular part 430 in the fore of the medial side of the rear foot part returns to the original shape.

As described above, while the lower portions 31 of the tubular parts 130, 230, 330 and 430 undergo large bending deformation on the lateral and medial sides of the foot, the upper portions 32 of the tubular parts 130, 230, 330 and 430 perform relatively small bending deformation, during the period from the "heel-contact" to the "heel-rise", as shown FIGS. 12(*a*) to 13(*d*).

During a series of motions from the time of the "heel-contact" to the time of the "heel-rise", the lower portions 31 of the tubular parts 130, 230, 330 and 430 perform bending deformation and, as shown in FIGS. 12(*c*) and 13(*c*), end portions 233, 433 in the front side of the tubular parts 230, 430 displace a little in the longitudinal direction with respect to the midsole M. The displacement of the end portions 233, 433 allows large bending deformation of the lower portions 31. It is speculated that the upper portions 32 is preferably curved to some extent so as to allow displacement of the end portions 233, 433.

On the lateral side of the rear foot part, the shoe sole sequentially makes contact with the ground forward from its rear end part and accordingly, the position on which a load is imposed is gradually moved forward. Therefore, by disposing the two tubular parts 130, 230 on the lateral side of the rear foot part of the shoe sole along the longitudinal direction, it is possible to effectively absorb shock over the whole area on the lateral side of the rear foot part.

On the other hand, on the medial side of the rear foot part, while the forward tubular part 430 undergoes large bending deformation, the rearward tubular part 330 undergoes small bending deformation. This is believed to be due to that, on the medial side of the rear foot part, the portion near the arch is subjected to a large load, while the portion near the heel is subjected to a small load. Therefore, the tubular part 330 in the rear of the medial side of the rear foot part may be replaced with the midsole M.

As understood from the fact that bending deformation of the tubular parts 330, 430 on the medial side of the rear foot part is larger than that of the tubular parts 130, 230 on the lateral side of the rear foot part, the foot can may incline toward the medial side during landing. To prevent this inclining for improving stability, in the deformation test, a vertical compression stiffness per unit area of each deformation element 3 on the lateral side of the rear foot part is set smaller than that of each deformation element 3 on the medial side of the rear foot part. As described above, this setting is achieved by making the Young's modulus of the shock absorbing member 35 in the tubular parts 330, 430 on the medial side larger than the Young's modulus of the shock absorbing member 35 in the tubular parts 130, 230 on the lateral side, or making stiffness of the tubular parts 330, 430 larger than stiffness of the tubular parts 130, 230 on the lateral side.

As described above, on the medial side of the rear foot part, the load imposed on the rearward tubular part 330 is far smaller than the large load imposed on the forward tubular part 430. Therefore, the compression stiffness of the forward deformation element (a third deformation element) near the arch of the two deformation elements on the medial side of the rear foot part may be set to be larger than that of the deformation element on the lateral side of the rear foot part and that of the deformation element in the rear of the medial side of the rear foot part.

Second Embodiment

Figure 5:
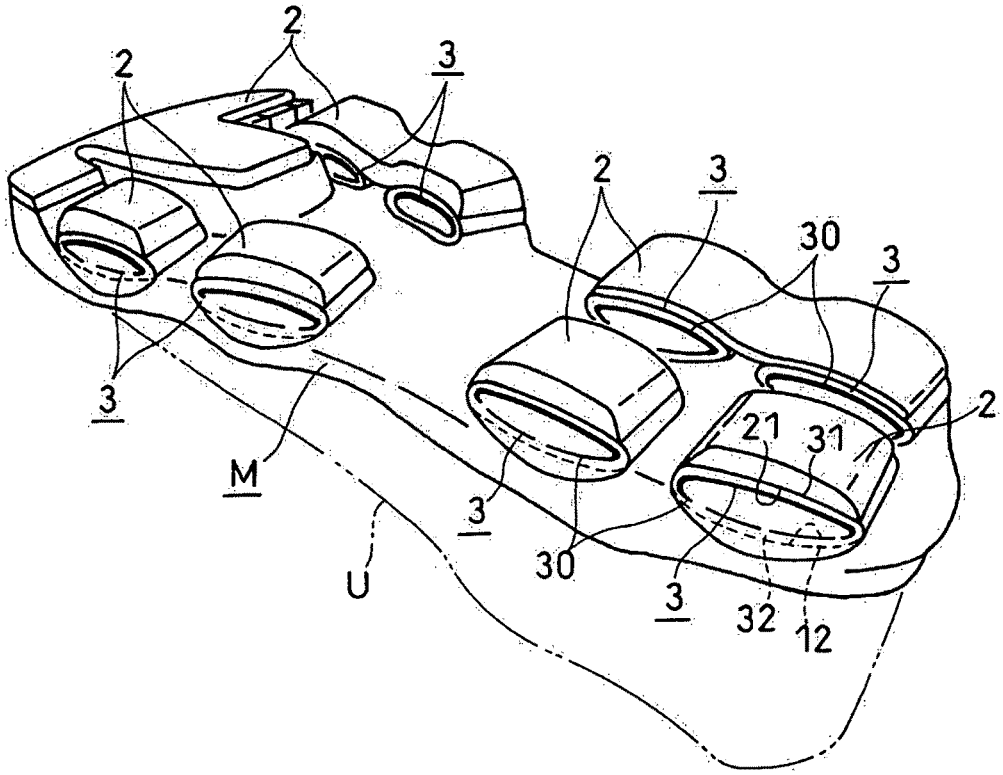
FIG. 5 is a perspective view of a shoe according to a second embodiment of the present invention viewed from the bottom side.

FIG. 5 shows the second embodiment. Note that, in the description of the following embodiments, the parts which are identical or corresponding to those of the first embodiment are designated by the same reference numerals as the first embodiment and the detailed description thereof will be omitted.

In this embodiment, as shown in FIG. 5, the deformation elements 3 is also provided on the medial and lateral sides of the fore foot part of the foot in addition to the rear foot part of the foot. This deformation element 3 consists of the tubular part 30. That is, unlike the first embodiment, there is no cushioning member within the tubular part 30, and therefore, the tubular part 30 is hollow on the inside.

In this embodiment, the connecting member for retaining the tubular part 30 is not provided, and the upper portion 32 of the tubular part 30 (lower half of the tubular part 30 in FIG. 5) is directly fit into the second curved surface 12 of the midsole M. The upper portion 32 of the tubular part 30 of this embodiment is formed to be rolling upwards at the lateral side face and the medial side face of the foot.

The outer sole 2 is adhesive bonded onto the lower portion 31 of the tubular part 30 (upper half of the tubular part 30 in FIG. 5). On the lateral side of the rear foot part, unlike the first embodiment, the outer sole 2 is divided into two, which are spaced apart from each other to cover the respective tubular part 30. On the medial side of the rear foot part, similarly to the first embodiment, the outer sole 2 is provided so as to cover two tubular parts 30 arranged along the longitudinal direction. In this embodiment, the midsole M is integrally formed without being divided.

Third Embodiment

Figure 6:
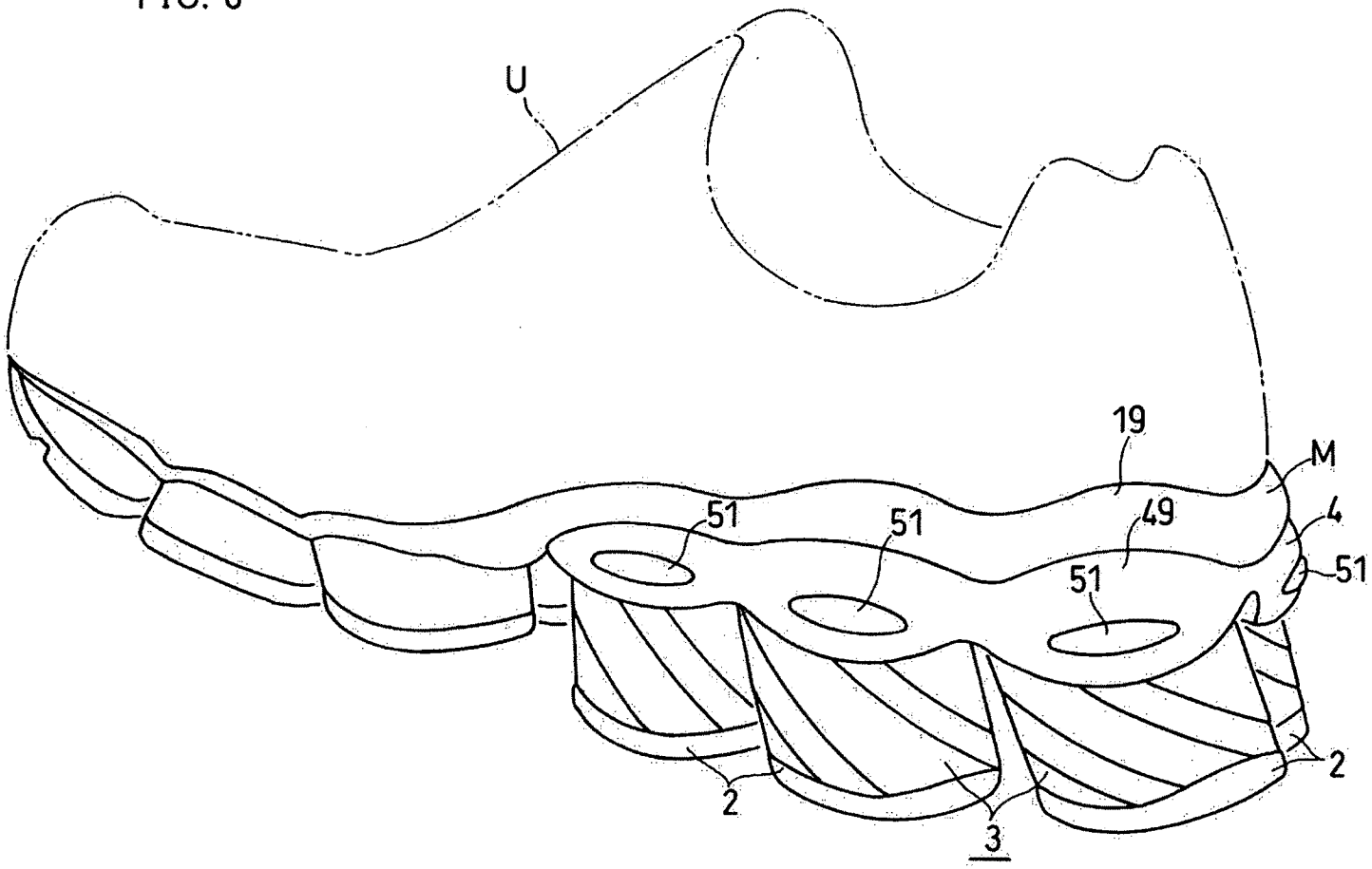
FIG. 6 is a perspective view of a shoe according to a third embodiment of the present invention viewed from the upper side.
Figure 7:
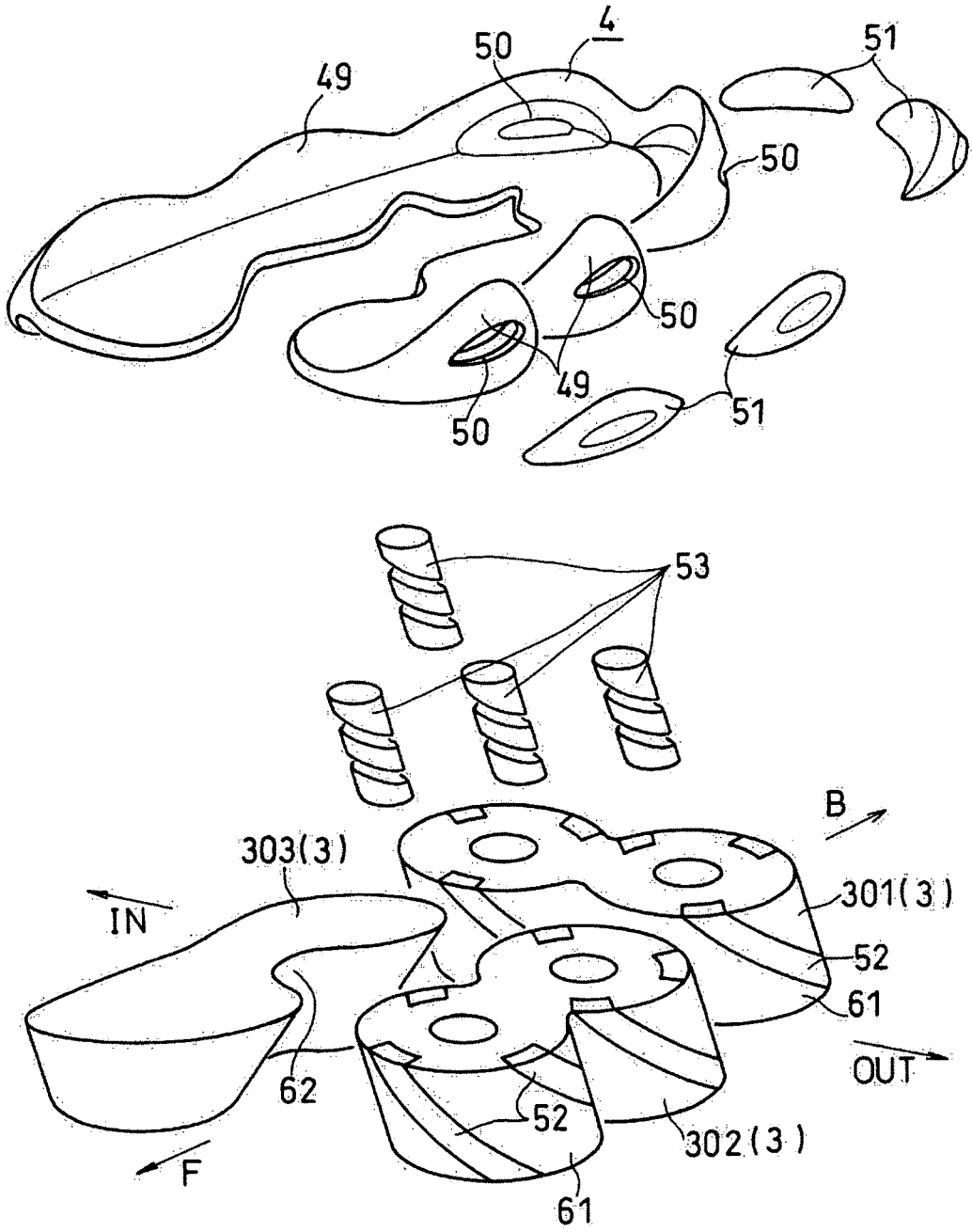
FIG. 7 is an exploded perspective view of deformation elements and a connecting member of the shoe sole.
Figure 8A:
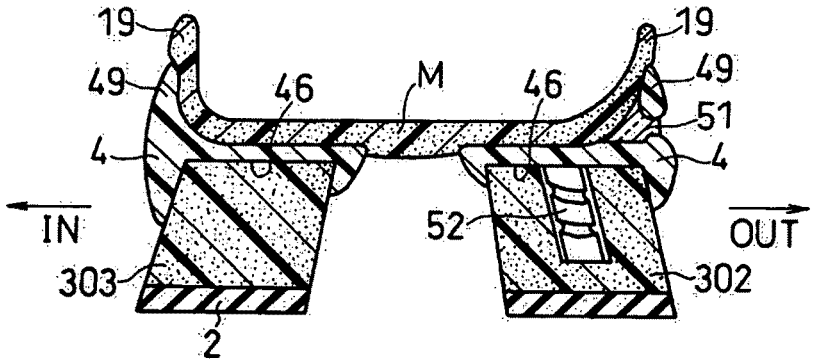
FIG. 8(*a*) is a transverse sectional view of the shoe sole in a rear foot part and FIG. 8(*b*) is a transverse sectional view of a shoe sole according to a modified embodiment in the rear foot part.
Figure 8B:
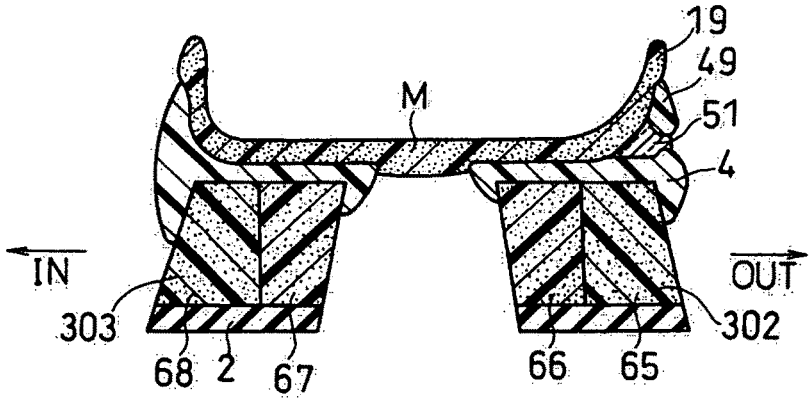

FIGS. 6 to 8 shows the third embodiment. In the figures, the arrow IN indicates the direction toward the medial side of the foot, the arrow OUT indicates the direction toward the lateral side of the foot, the arrow F indicates the direction toward the front of the foot and the arrow B indicates the direction toward the rear of the foot.

In this embodiment, as shown in FIG. 6, a plurality of generally columnar deformation elements 3 are provided. The connecting member 4 for retaining these deformation elements 3 is provided to be continuous along a side face of the rear foot part of the foot.

FIG. 7 is an exploded perspective view of the deformation elements 3, the connecting member 4 and so on in the rear foot part of the foot.

In this embodiment, as shown in FIG. 7, three deformation elements 3 are provided in the rear foot part. The upper and bottom surfaces of each deformation element 3 are formed to be flat (uncurved).

The first deformation element 301 is disposed at the heel side of the rear foot part. The second deformation element 302 is disposed forward F of the first deformation element 301 on the lateral side of the rear foot part. These deformation elements 301, 302 includes a figure eight shaped portion 61 having a generally figure eight shaped plane section and gels 52, 53. The figure eight shaped portion 61 is made of foam of EVA. Young's modulus of the gels 52, 53 is smaller than that of the figure eight shaped portion 61. Helical grooves are provided on the outer circumferential surface of the figure eight shaped portion 61 and the gels 52 are fit into the grooves. Two central holes are provided in the figure eight shaped portion 61 and the columnar gels 53 are fit into the holes. Helical, grooves are provided on the outer circumferential surface of the columnar gels 53.

On the other hand, the third deformation element 303 is disposed forward F of the first deformation element 301 on the medial side of the rear foot part of the foot. The third deformation element 303 is made of foam of EVA and arranged to be opposed to the second deformation element 302 on the lateral side of the rear foot part. The third deformation element 303 is made only of foam of EVA while the second deformation element 302 is made of foam of EVA and gels. Accordingly, a vertical compressive stiffness per unit area of the third deformation element 303 on the medial side is larger than that of the second deformation element 302 on the lateral side.

Furthermore, the third deformation element 303 on the medial side has a concave 62 extending from the medial-lateral center toward the medial side. Such configuration makes the third deformation element 303 is more difficult to compress vertically in the medial and lateral side portions than in the medial-lateral central portion.

The connecting member 4 is formed along the side face of the rear foot part of the foot, and the medial-lateral central portion thereof is notched along the longitudinal direction. The connecting member 4 is made of a material having larger Young's modulus than the midsole. The deformation elements 301, 302, 303 are joined to the bottom surface of the connecting member 4.

The connecting member 4 includes a second roll-up portion 49 rolling upwards along the side face of the foot at the periphery. Through holes 50 are provided below the second roll-up portion 49 having a generally ellipsoid shape and gels 51 are fit into the through holes 50.

FIG. 8(*a*) is a transverse sectional view of the shoe sole in the rear foot part.

As shown in FIG. 8 (*a*), each of the medial and lateral deformation elements 303, 302 is inclined a little toward the medial-lateral center as it go upward.

Furthermore, the first roll-up portion 19 is provided at the medial and lateral side portions of the midsole M. Outside the first roll-up portion 19, the second roll-up portion 49 is disposed, thereby supporting the first roll-up portion 19. Thus, the soft midsole M supporting the foot is supported by the hard connecting member 4. Since the first and second roll-up portions 19, 49 are extending over substantially the whole of the periphery of the rear foot part as shown in FIG. 6, the whole of the rear foot part of the foot can be stably supported.

Furthermore, recessed portions 46 are provided on the bottom surface of the connecting member 4, the deformation elements 301, 302, 303 are fit into the recessed portions 46 to be retained by the connecting member 4. Such configuration prevents the deformation element 3 from bending sharply at its root portion, thereby improving the stability.

FIG. 8(*b*) is a transverse sectional view of a shoe sole according to a modified embodiment in the rear foot part.

In this modified embodiment, each of the medial and lateral deformation elements 303, 302 includes two different materials, one forming the medial-lateral central portion and the other forming the medial or lateral side portion. That is, in the third deformation element 303, the medial side portion 68 is formed of harder material and the medial-lateral central portion 67 is formed of softer material. In the deformation element 302 on the lateral side, the medial-lateral central portion 66 is formed of softer material and the lateral side portion 65 is formed of a little harder material (material which is harder than the materials forming the medial-lateral central portions 66, 67 and softer than the medial side portion 68).

In this case, each of the deformation elements 303, 302 is more difficult to compress vertically in the medial and lateral side portions 68, 65 than in the medial-lateral central portions 67, 66. Comparing the difficulty of the vertical compression between the deformation elements 303, 302 on the whole, a vertical compressive stiffness per unit area of the deformation element 302 disposed on the lateral side is smaller than that of the deformation element 303 disposed on the medial side of the rear foot part, because the second deformation element 302 on the lateral side is softer than the third deformation element 303 on the medial side.

Fourth Embodiment

Figure 9:
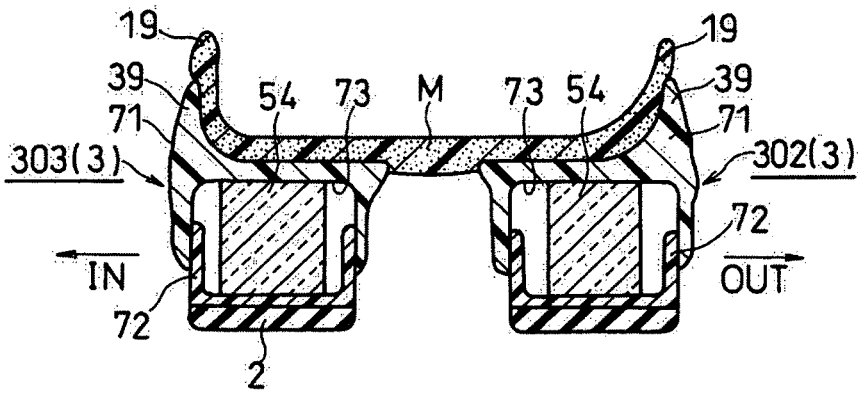
FIG. 9 is a transverse sectional view of a shoe sole according to a fourth embodiment in the rear foot part.

FIG. 9 is a transverse sectional view of a shoe sole according to the fourth embodiment in the rear foot part.

As shown in FIG. 9, in this embodiment, the medial and lateral deformation elements 303, 302 each include an upper portion 71, a lower portion 72 and columnar gels 54 sandwiched between the upper and lower portions 71, 72, but, unlike the third embodiment, does not include the connecting member. Young's modulus of a material forming the upper portion 71 is larger than that of the material forming the midsole M.

Fitting holes 73 are provided on a bottom surface of the upper portion 71 and the lower portion 72 are slidably fit into the fitting holes 73. When the load is applied from below, the gel 54 is compressed vertically and the lower portion 72 slides toward above in the fitting hole 73, i.e., the deformation elements 303, 302 are compressed vertically.

The gel 54 of the lateral deformation element 302 is thinner than the gel 54 of the medial deformation element 303. Therefore, compressive stiffness per unit area of the lateral deformation element 302 is smaller than that of the medial deformation element 303.

The upper portion 71 includes the third roll-up portion 39 supporting, from outside, the first roll-up portions 19 provided at the medial and lateral side portions of the midsole M. Thus, an effect similar to the effect of the first and second roll-up portions 19, 49 of the third embodiment can be achieved.

Fifth Embodiment

FIGS. 14 to 21 shows the fifth embodiment.

Figure 14A:
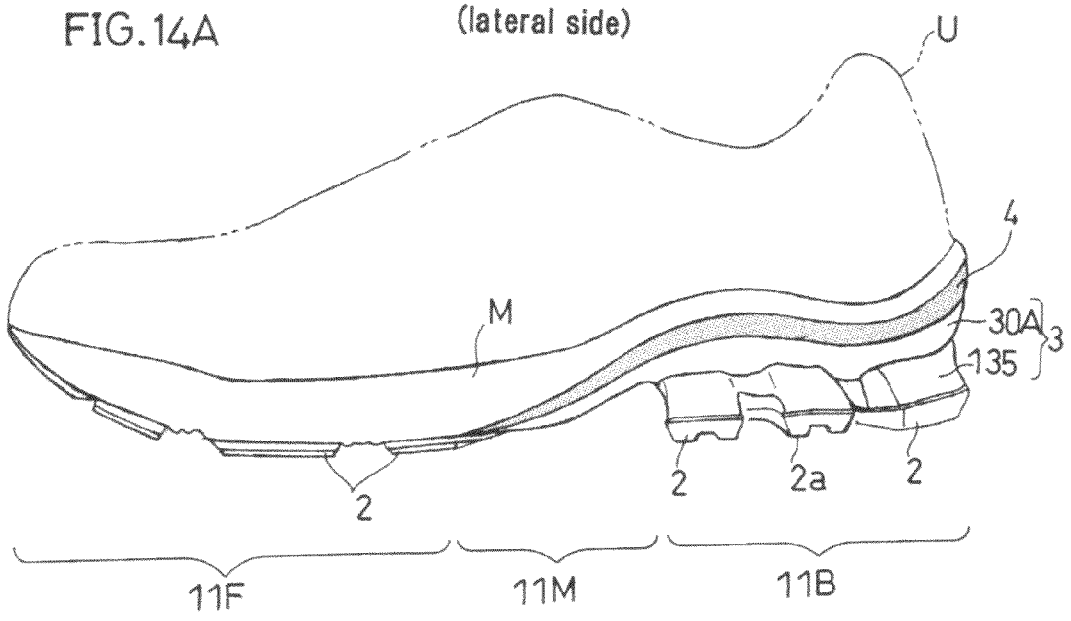
FIG. 14A is a lateral side view of a shoe according to a fifth embodiment and FIG. 14B is a medial side view thereof.
Figure 14B:
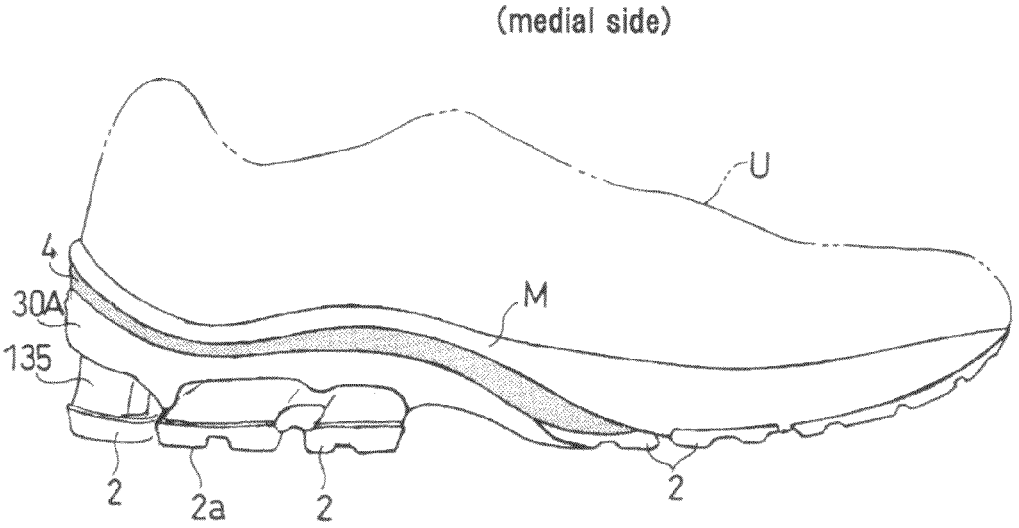

FIG. 14A shows a lateral side of the shoe (for a left foot) of the fifth embodiment and FIG. 14B shows a medial side of the same shoe.

As shown in FIGS. 14A, 14B, the shoe sole of this embodiment includes an midsole M, an outer sole 2, a deformation section 3 and a connecting member 4. The deformation section 3 consists of a bending deformation member 30A and rubber-like members 135 (an example of a compression deformation member).

The outer sole 2 is joined to the bottom surface of the midsole M in the fore foot part (toe part) 11F. The connecting member 4 is joined to the bottom surface of the midsole M in an area extending from the mid foot part (arch part) 11M and the rear foot part (heel part) 11B. The upper surface of the bending deformation member 30A is joined to the bottom surface of the connecting member 4, and the rubber-like members 135 are arranged to be sandwiched between portions of the connecting member 30A. The outer sole 2 is joined to the bottom surface of the bending deformation member 30A. An insole (not shown) is adhesive bonded onto the midsole.

In FIGS. 14A, 14B, the connecting member 4 is dot-meshed in order to understand easily the relationship among the members.

The midsole M is, for example, formed of a material suitable for shock absorption, such as resin foam of EVA (ethylene-vinyl acetate copolymer), polyurethane or the like. The midsole M can support at least the whole of the rear foot part of the foot and absorb the shock of landing by undergoing compression deformation due to the shock. Above the midsole M and the insole, the upper U suitable for covering the instep of the foot is disposed, as shown by two-dot chain line in FIG. 14A, 14B. The outer sole 2 is made of a material having higher abrasion resistance than the midsole M and has a ground contact surface 2*a* that contacts the ground surface or the floor surface at landing.

The connecting member 4 and the bending deformation member 30A are sandwiched between the outer sole 2 and the midsole M at the front end of the mid foot part 11M.

Figure 15:
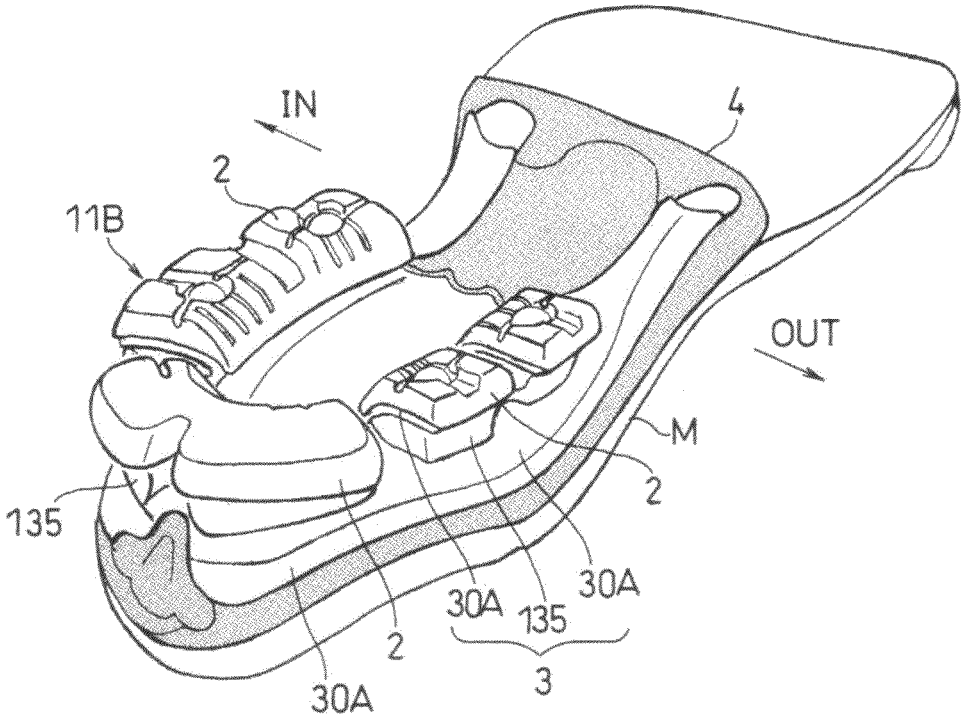
FIG. 15 is a perspective view of the shoe sole viewed from the bottom side.

In FIG. 15, the illustration of the outer sole of the fore foot part is omitted.

Figure 16:
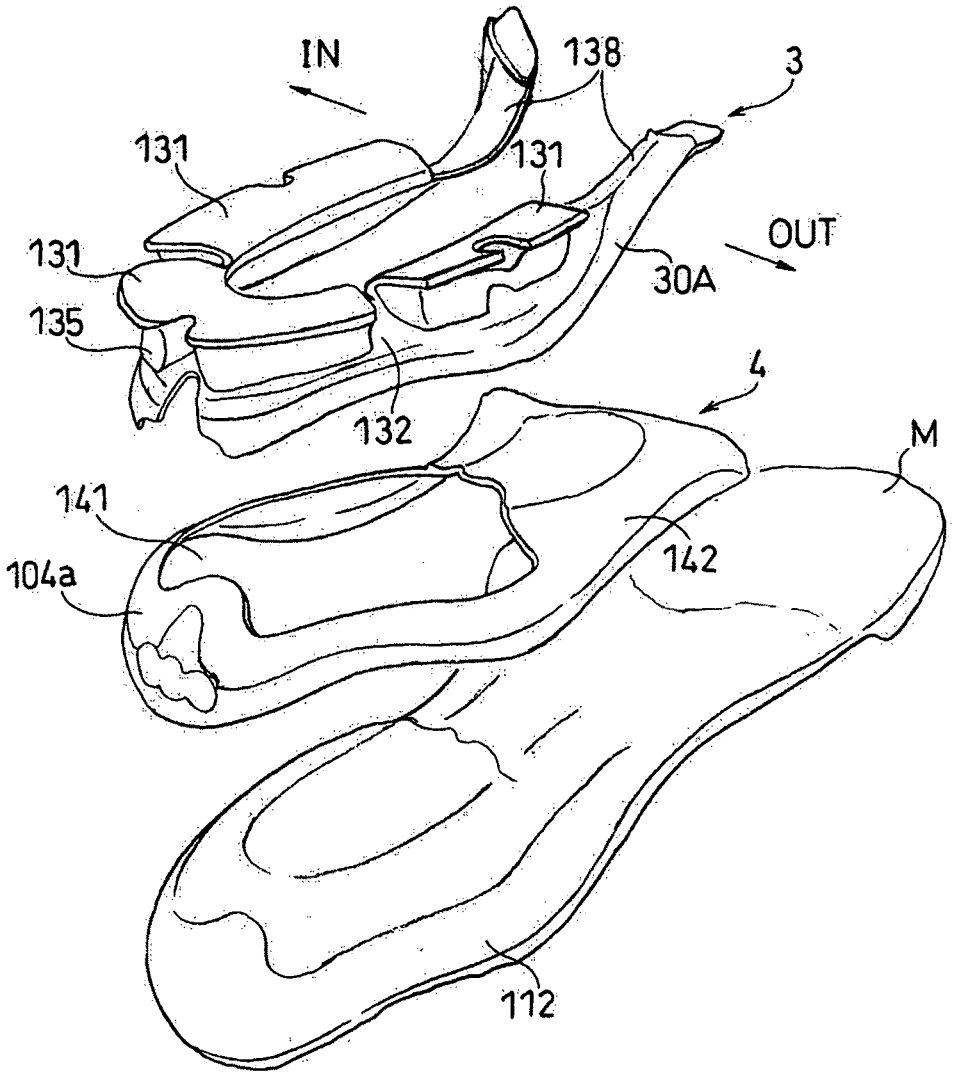
FIG. 16 is an exploded perspective view of the shoe sole viewed from the bottom side.

As shown in FIG. 15, the outer sole 2 is arranged along the periphery of the rear foot part 11B and is divided into three. The three divided outer soles 2 are disposed on the lateral side of the rear foot part 11B, the medial side of the rear foot part 11B and the rear end of the rear foot part, respectively, and they are spaced apart from each other. That is, the divided outer soles 2 are substantially separated in the medial-lateral direction and in the longitudinal direction to be arranged at three regions of the rear foot part 11B. As shown in FIG. 16, the bending deformation member 30A above the outer sole 2 is arranged along the periphery of the foot in the area extending from the mid foot part 11M (FIG. 14A) and the rear foot part 11B (FIG. 14A). The connecting member 4 above the bending deformation member 30A is arranged along the periphery of the foot in the area extending from the mid foot part and the rear foot part and covers substantially the whole of the mid foot part of the midsole M.

In the rear foot part of the foot, a quotient obtained by dividing an area of the bottom surface of the midsole M by an area of the bottom surface of the outer sole 2 is set at about 1.3 or more.

Figure 17:
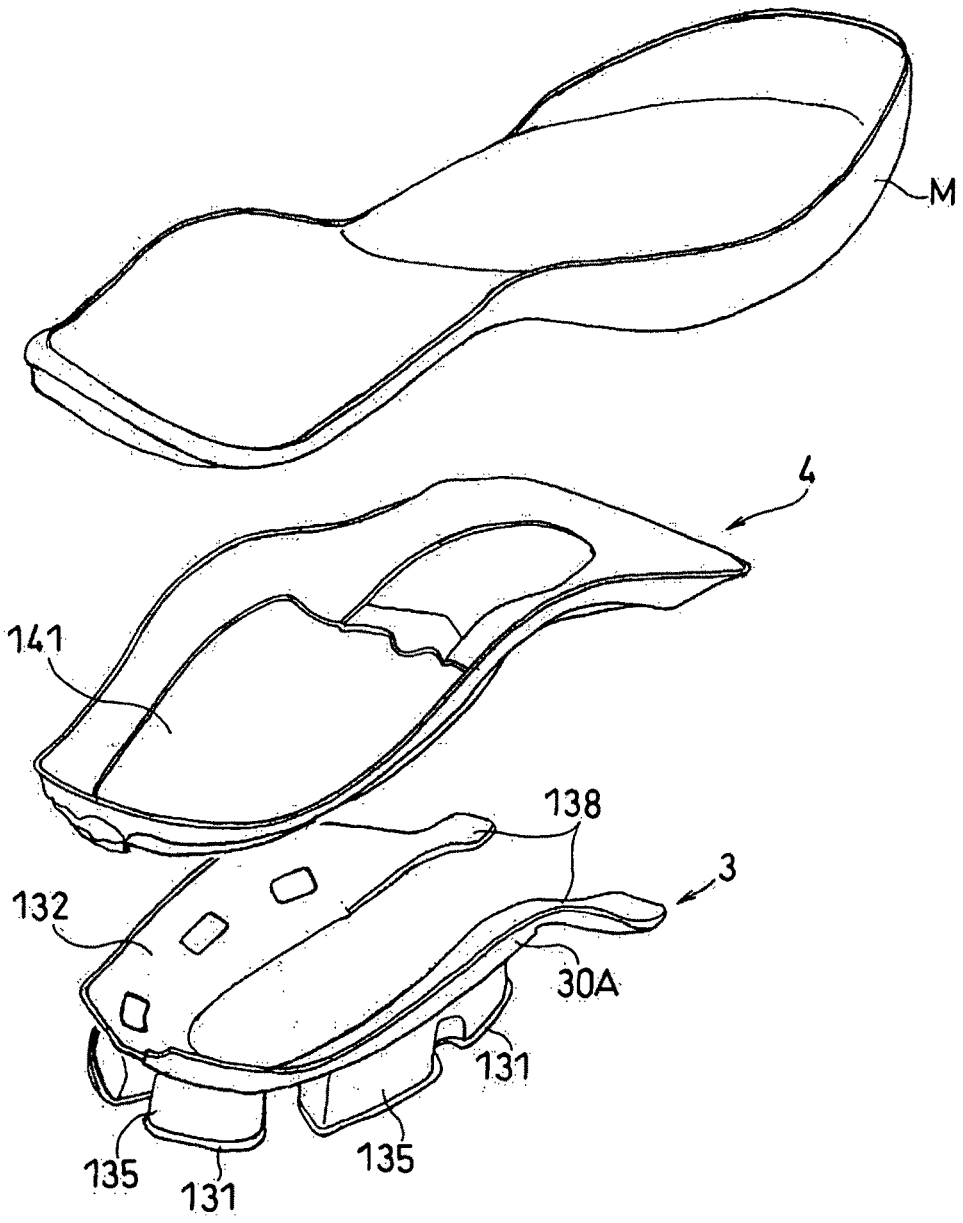
FIG. 17 is an exploded perspective view of the shoe sole viewed from the upper side.

FIGS. 16, 17 are exploded perspective views of the deformation section 3, the connecting member 4 and the midsole M. FIG. 16 is a view from the bottom side and FIG. 17 is a view from the upper side.

As shown in FIG. 16, the bending deformation member 30A of the deformation section 3 is generally horseshoe-shaped (similar to the U-shape) in a plan view and extends from the medial side IN of the mid foot part to the lateral side OUT of the mid foot part through the medial side IN, the rear end, and the lateral side OUT of the rear foot part. A portion of the bending deformation member 30A in the mid foot part constitutes a first reinforcing part 138 for restraining the torsion of the arch. In the rear foot part, the bending deformation member 30A includes a lower plate portion 131 disposed on the outer sole side and an upper plate portion 132 disposed on the midsole side. The rubber-like members 135 are fit between the upper and lower plate portions 132, 131. This bending deformation member 30A is joined to a joining face 104*a* provided on the bottom surface of the connecting member 4 and joined to the bottom surface of the midsole M.

The connecting member 4 interposed between the deformation elements 3 and the midsole M extends from the mid foot part to the rear foot part. In the rear foot part, the connecting member 4 is formed in a loop shape so as to extend over the medial side IN, the rear end and the lateral side OUT of the rear foot part. An opening 141 is provided in the connecting member 4 at the central portion of the rear foot part. In the mid foot part, the connecting member 4 covers substantially the whole of the midsole M and constitutes a second reinforcing part 142 for restraining the torsion of the arch of the shoe. The connecting member 4 is joined to a joining face 112 provided on the bottom surface of the midsole M.

At the central portion of the mid foot part, the connecting member 4 and the midsole M are not joined to each other. That is, at the central portion of the mid foot part, the connecting member and the midsole M are vertically spaced from each other. Since the opening 141 is provided in the connecting member 4, the bottom surface of the midsole M at the central portion of the rear foot part is exposed without being covered by the connecting member 4 nor the deformation section 3 (FIG. 15). Such constitution enables the midsole M to sink down at the central portion of the rear foot part, thereby improving the cushioning property.

Figure 18A:
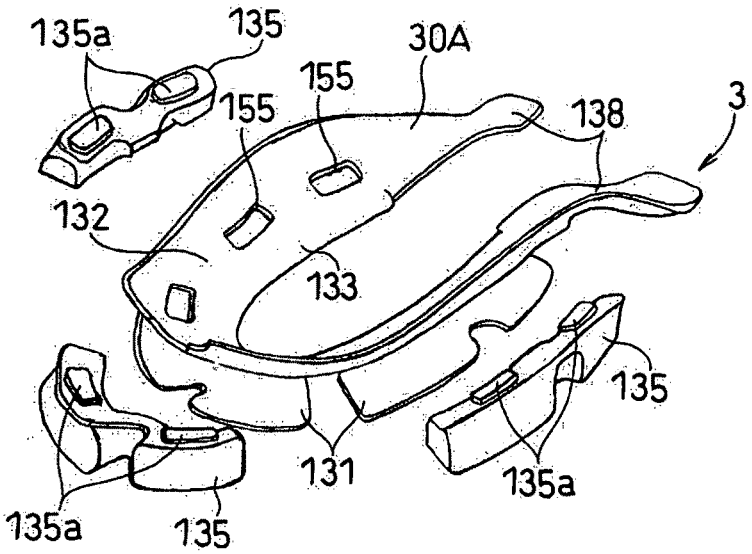
FIG. 18A is an exploded perspective view of a bending deformation member and rubber-like members viewed from the upper side and FIG. 18B is an exploded perspective view thereof viewed from the bottom side.
Figure 18B:
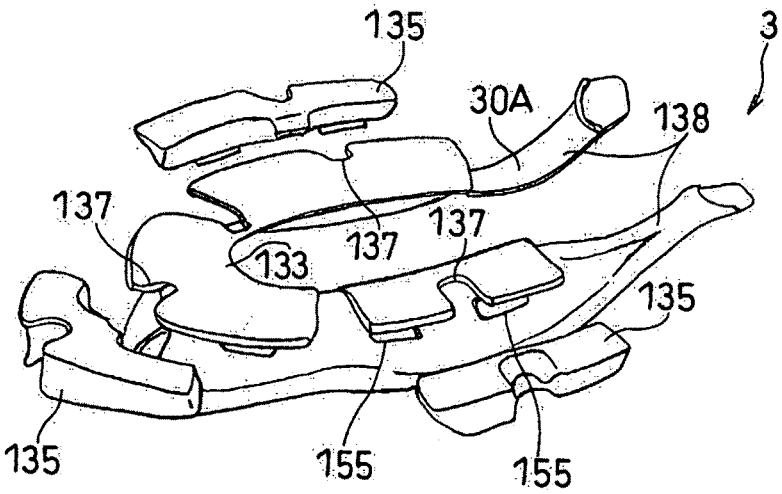

Deformation Section:

As shown in FIGS. 18A, 18B, the deformation section 3 includes one bending deformation member 30A and three rubber-like members 135. The bending deformation member 30A includes: the upper plate portion 132 indirectly joined to the bottom surface of the midsole M via the connecting member 4; the lower plate portion 131 joined to the upper surface of the outer sole 2; and a hinge portion 133 (an example of an curved portion) connecting the upper and lower portions 132, 131. The upper and lower plate portions 132, 131 and the hinge portion 133 are integrally formed with each other from synthetic resin.

The deformation section 3, on the whole, can deform to be compressed vertically due to the shock of landing. At this time, the bending deformation member 30A undergoes bending deformation due to the shock of landing and, on the other hand, the rubber-like members 135 undergo compression deformation so as to restrain the bending deformation of the bending deformation element 30A. It is preferred that the height of the deformation section (maximum vertical length of the bending deformation member 30A in regions where the rubber-like members 135 are attached) is set within a range of about 8 mm to about 50 mm.

As shown in FIG. 18A, the upper plate portion 132 is provided continuously along the periphery of the rear foot portion and connected to the first reinforcing part 138 of the mid foot part. The rear end portion of the upper plate portion 132 is partially notched (FIG. 16). A plurality of generally square-shaped through holes 155 are provided in the upper plate portion 132.

As shown in FIG. 18B, the lower plate portion 131 is provided along the periphery of the rear foot part. The lower plate portion 131 is divided longitudinally at a position between the rear end and the medial side of the rear foot part and at a position between the rear end and the lateral side. Thus, the lower plate portion 131 is divided into three separated regions: the medial side region of the rear foot part; the rear end region of the rear foot part; and the lateral side region of the rear foot part. Each region of the lower plate portion 131 has a generally U-shaped notch 137 at an extremity remote from the hinge portion 133.

Figure 19A:
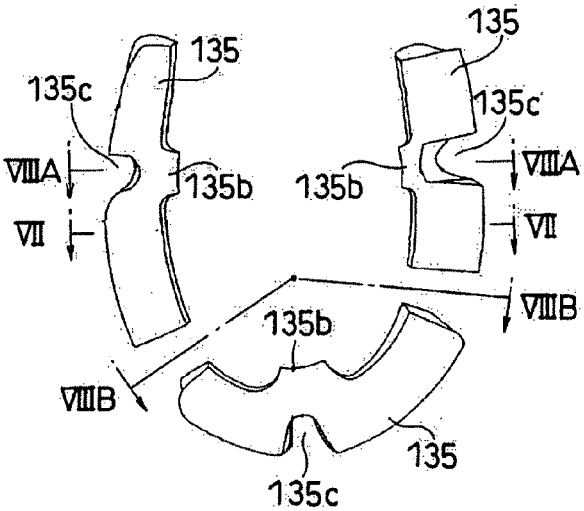
FIG. 19A is a bottom plan view of the rubber-like members according to this embodiment and FIGS. 19B and 19C are bottom plan views of the rubber-like members according to modified embodiments.
Figure 19B:
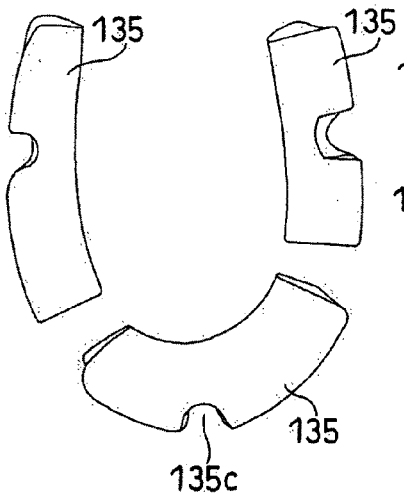

Three rubber-like members 135 are each sandwiched between the upper and lower plate portions 132, 131 and adhesive-joined to the upper and lower plate portions 132, 131. As shown in FIG. 19A, the rubber-like member 135 has a planar shape corresponding to that of the respective region of the lower plate portion 131, and has a notch 135*c* at a position corresponding to the notch 137 of the lower plate portion 131.

As shown in FIG. 18A, upper protrusions 135*a* protruding upwards are provided on the upper surface of the rubber-like member 135. These upper protrusions 135*a* are fit into and engaged with the through holes 155 of the upper plate portion 132. Thus, when the deformation section 3 is vertically compressed in a bonding process of manufacturing the deformation section, the rubber-like members 135 can be supported stably between the upper and lower plate portions 132, 131. In order to support the rubber-like members 135 more stably between the upper and lower plate portions 132, 131, the upper plate portion 132 and/or the lower plate portion 131 may have a through hole and/or a protrusion.

Since the lower plate portion 131 is divided into three regions spaced apart from each other and the three rubber-like members 135 are arranged in accordance with the three regions, the deformation elements 3 of the deformation section are substantially separated at least in the medial-lateral direction and in the longitudinal direction in the rear foot part so that the deformation elements 3 are arranged at least three regions: the lateral side region of the rear foot part; the medial side region of the rear foot part; and the rear end region of the rear foot part. Such separation of the deformation elements 3 enables the deformation of the shoe sole in accordance with the regions of the rear foot part and so enables smooth motion of the foot during the period from the landing of the rear end of the rear foot part to the forward bending of the foot. Furthermore, the notches 137 of the lower plate portion 131 and the notches 135*c* of the rubber-like members 135 enable more smooth motion of the foot.

A vertical compressive stiffness of the deformation element 3 disposed on the lateral side of the rear foot part may be set smaller than that of the deformation element 3 disposed on the medial side of the rear foot part. Such setting is realized, for example, in a case where a vertical compressive stiffness per unit area of a material forming the medial deformation element is different from a material forming the lateral deformation element or in a case where the medial and lateral deformation elements are different in size.

Young's modulus of a material forming the bending deformation element 30A is larger than that of a material forming the midsole M and larger than that of a material forming the outer sole 2. Furthermore, the Young's modulus of the material forming the bending deformation member 30A is preferably set larger than Young's modulus of a material forming the connecting member 4, and the Young's modulus of the material forming the connecting member 4 is preferably set larger than the Young's modulus of the material forming the midsole M. Such settings make the shock of landing dispersed by the relatively hard bending deformation member 30A and more dispersed by the connecting member 4, thereby producing a soft sensation on the sole of the foot.

Young's modulus of a material forming the rubber-like member 135 is smaller than the Young's modulus of the material forming the bending deformation member 30A. Elastic proportional limit with respect to a compressive load of the material forming the rubber-like member 135 is larger than that of the material forming the midsole M.

In view of the cushioning property and the stability, the Young's modulus of the rubber-like member 135 (coefficient of elasticity within the elastic proportional limit) is preferably set at 0.1 kgf/mm$^2$ to 5.0 kgf/mm$^2$, more preferably set at 0.3 kgf/mm$^2$ to 3.0 kgf/mm$^2$, and most preferably set at 0.3 kgf/mm$^2$ to 2.0 kgf/mm$^2$. In this case, the Young's modulus of the bending deformation element 30A is preferably set at 1.0 kgf/mm$^2$ to 30 kgf/mm$^2$, more preferably set at 2.0 kgf/mm$^2$ to 15 kgf/mm$^2$, and most preferably set at 3.0 kgf/mm$^2$ to 10 kgf/mm$^2$.

The rubber-like member 135 may be formed of rubber or rubber-like synthetic resin (thermoplastic elastomer). In the case where the rubber-like member is formed of rubber-like synthetic resin, for example, gel (commercial name for the cushioning member), a material of the rubber-like member 135 may be, for example, polyurethane gel or styrene gel, which can improve the adhesion between the rubber-like member 135 and the bending deformation member 30A. The material of the bending deformation member 30A may be, for example, non-foam resin such as nylon, polyurethane and FRP. Instead of the rubber-like member 135, a member that deforms so as to store a force of restitution (repulsion) while being compressed, such as a pod-like member in which air, liquid, gel-like material or soft rubber-like elastic material is filled, may be used.

Figure 20:
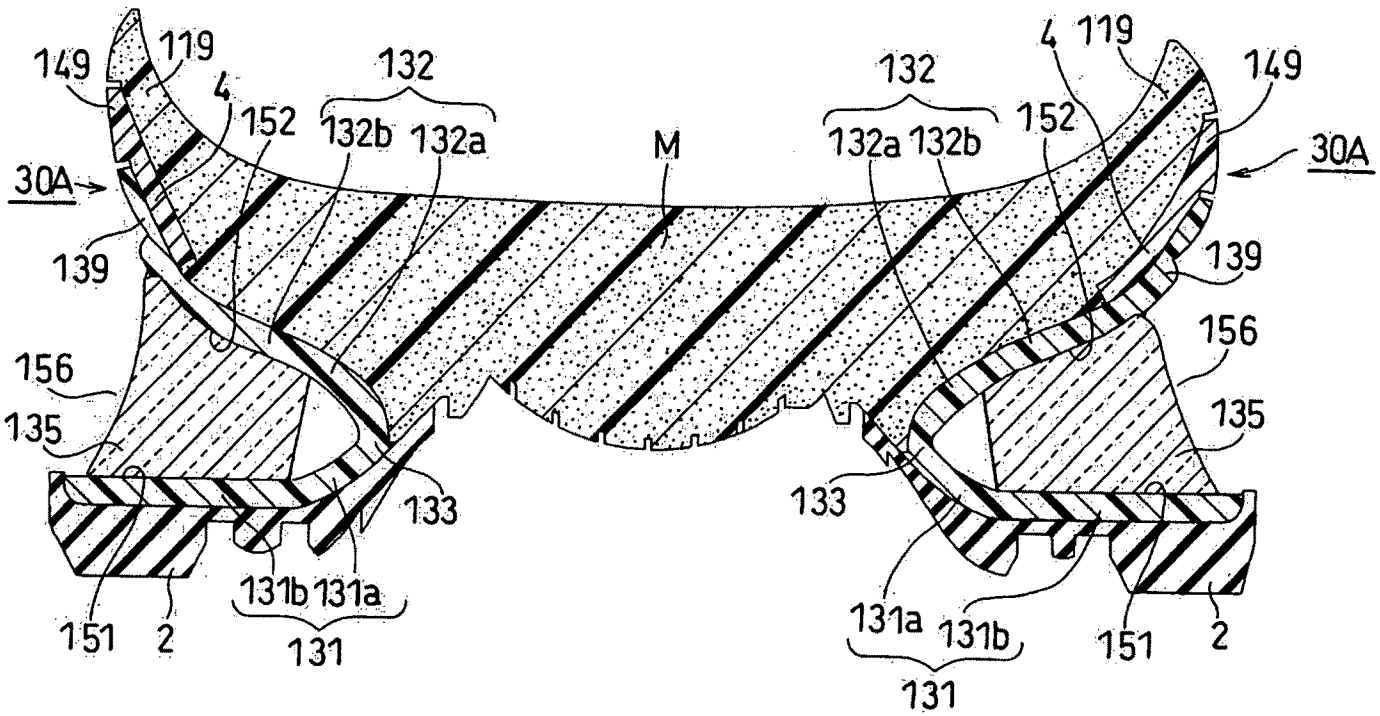
FIG. 20 is a sectional view of the shoe sole taken along the line VII-VII of FIG. 19A.
Figure 21A:
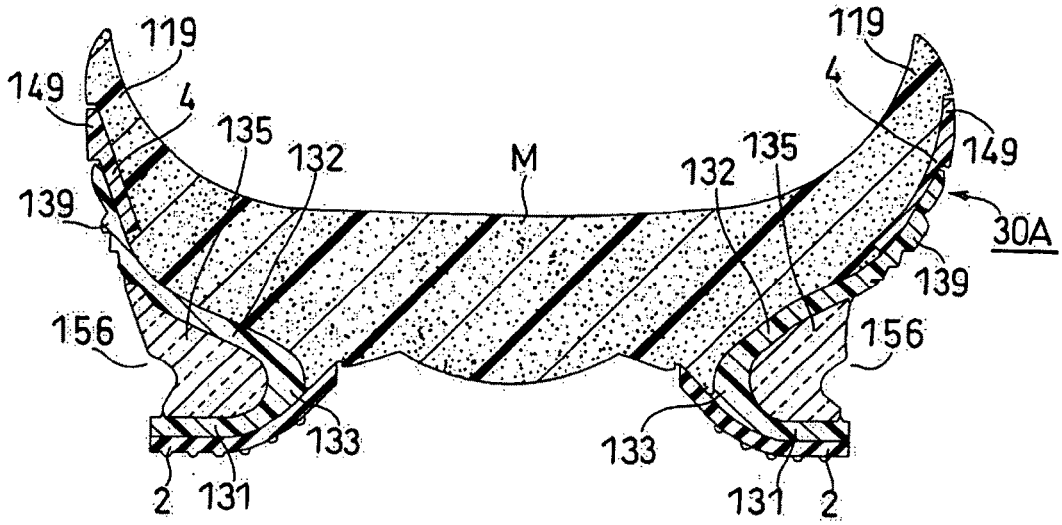
FIG. 21A is a sectional view of the shoe sole taken along the line VIIIA-VIIIA of FIG. 19A.
Figure 21B:
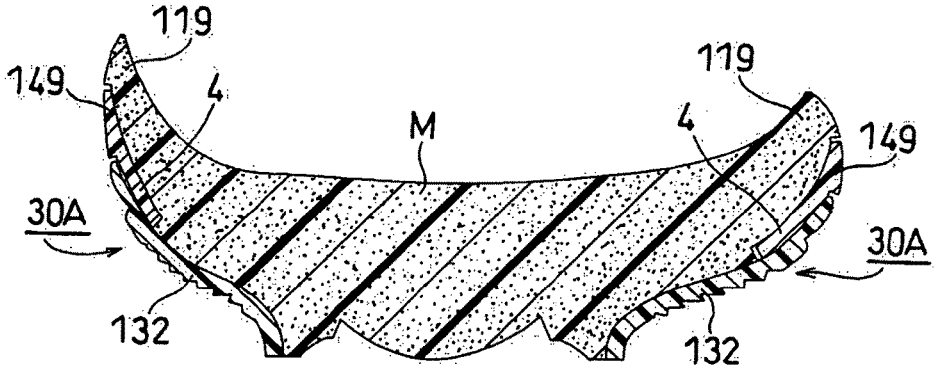
FIG. 21B is a sectional view of the shoe sole taken along the line VIIIB-VIIIB of FIG. 19A.

Sectional Shape of the Deformation Section:

In this embodiment, as shown in FIGS. 20, 21A, the bending deformation member 30A has a generally V-shaped cross section in an region where the rubber-like member 135 is provided and opens toward the periphery of the rear foot portion thereby forming an opening 156. That is, the upper and lower plate portions 132, 131 have respective opposed surfaces 152, 151 opposed to each other, the opposed surface 152 of the upper plate portion 132 and the opposed surface 151 of the lower plate portion 131 gradually getting away from each other as it goes from the hinge portion 133 toward the opening 156.

The lower plate portion 131 has a first lower area 131*a* being in the vicinity of the hinge portion 133 and a second lower area 131*b* being nearer to the opening 156 than the first lower area 131*a*, and the rubber like member 135 is in contact with the second lower area. The upper plate portion 132 has a first upper area 132*a* being in the vicinity of the hinge portion 133 and a second upper area 132*b* being in the vicinity of the opening 156, and the rubber like member 135 is in contact with the second upper area.

Figure 22A:
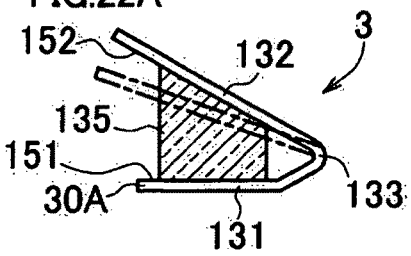
FIGS. 22A to 22G is schematic sectional views showing a various examples of the bending deformation member.
Figure 22B:
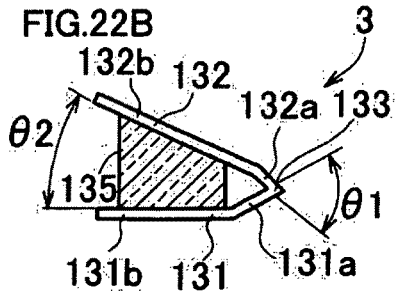

As shown in FIG. 22B, an angle (first opening angle) θ1 between the first upper area 132*a* and the first lower area 131*a* is larger than an angle (second opening angle) θ2 between the second upper area 132*b* and the second lower area 131*b*. That is, the angle between the upper and lower plate portions 132, 131 is set larger in the vicinity of the hinge portion 133 and smaller in the vicinity of the opening 156.

The first opening angle θ1 in an unloaded condition is preferably set at about 30 degrees to about 120 degrees, more preferably set at about 50 degrees to about 100 degrees, and most preferably set at about 60 degrees to about 90 degrees. An average of the second opening angle θ2 in an unloaded condition is preferably set at about 5 degrees to about 60 degrees, more preferably set at about 10 degrees to about 50 degrees, and most preferably set at about 15 degrees to about 45 degrees.

In this embodiment, the second lower area 131*b* is configured to be generally parallel to the ground surface. However, the second lower area 131*b* need not necessarily be arranged in such a configuration, and may be configured to be inclined upwards or downwards from the center toward the periphery of the rear foot part.

As shown in FIG. 20, 21A, 21B, a first roll-up portion 119 is integrally formed with the midsole M at the periphery of the rear foot part so as to be rolling upwards along the side face from the bottom face of the foot. Outside the first roll-up portion 119, a second roll-up portion 149 is arranged to be extending along the first roll-up portion 119. In addition, outside the second roll-up portion 149, a third roll-up portion (an example of another roll-up portion) 139, which is formed continuously from the upper plate portion 132 of the bending deformation member 30A, is arranged to be extending along the first roll-up portion 119. The first to third roll-up portions 119, 149, 139 enable the bending deformation member 30A to support easily a load transferred from the midsole M at the periphery of the rear foot part.

As shown in FIG. 20, the rubber-like member 135 is of such a shape that a vertical thickness thereof gradually becomes larger moving away from the hinge portion 133 between the upper and lower plate portions 132, 131 so as to be in conformity with the sectional shape of the bending deformation member 30A. The rubber-like member 135 is arranged in close contact with the surfaces (the opposed surfaces 152, 151) of the upper and lower plate portions 132, 131.

Since, as above-mentioned, the angle between the upper and lower plate portions 132, 131 is larger in the vicinity of the hinge portion 133 and smaller in the vicinity of the opening 156, the midsole M does not become thin at the center of the rear foot portion. Therefore, the rubber-like member 135 having a relatively large thickness can be disposed, thereby obtaining a improved cushioning property.

A side surface of the rubber-like member 135 facing the opening 156 is configured to be concave at vertically central portion. The reason is that such configuration makes the rubber-like member 135 easily deform when being compressed. This side surface need not necessarily be concave, and may be configured as shown in FIG. 22B.

As shown in FIGS. 18A, 18B, 19A, the rubber-like member 135 is concave in conformity with the U-shaped notch 137 at a position corresponding to the notch 137 of the lower plate portion 131, and has a inner protrusion 135*b* protruding toward the center of the rear foot part. Therefore, as shown in the sectional view of FIG. 21A, at the position corresponding to the notch 137, the rubber-like member 135 fit into the bending deformation member 30A up to the hinge portion 133 without clearance so as to be in close contact with the surface of the bending deformation member 30A. Such close contact makes the rubber-like member 135 held stably between the upper and lower plate portions 132, 131. On the other hand, as shown in the sectional view of FIG. 20, at the other position, there is a gap between the rubber-like member 135 and the hinge portion 133. Such a gap enables the rubber-like member 135 to escape toward the center of the rear foot part when being compressed, and so the rubber-like member 135 can easily deform.

The shape of the rubber-like member 135 is not limited to the shape shown in FIG. 19A, and other shapes may be applied. For example, the rubber-like member 135 may be configured without inner protrusion which is protruding toward the center of the rear foot part, i.e., the shape of the inner side of the rubber-like member 135 may be configured to be along the hinge portion 133 of the bending deformation member 30A. In this case, at almost all the positions, the rubber-like member 135 fit into the hinge portion 133 without clearance to be in close contact. Therefore, the rubber-like member 135 can be supported stably. And since there is no gap between the hinge portion 133 and the rubber-like member 135, foreign matters or the like can be prevented from entering into the deformation element and the bending deformation member can be prevented to being damaged due to such foreign matters.

Figure 19C:
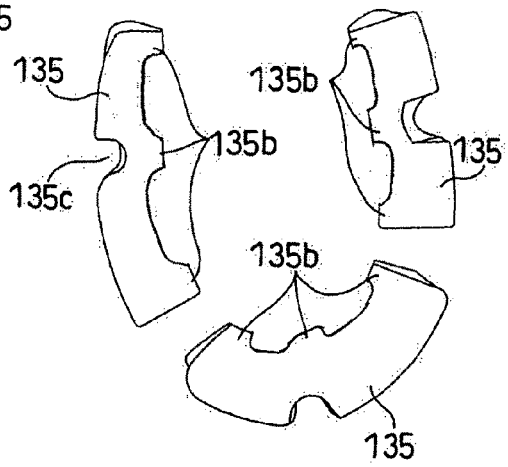

As shown in FIG. 19C, the rubber-like member 135 may includes three inner protrusions 135*b* protruding toward the center of the rear foot part. In this case, since the inner protrusions 135*b* are provided at both end portions and the central portion, the gap between the rubber-like member 135 and the hinge portion 133 is closed. Therefore, the entrance of foreign matters into the gap can be prevented while the deformability of the rubber-like member 133 is kept high.

The bending deformation member 30A has, preferably, a generally V-shaped or trapezoidal cross-section like this embodiment, but may have another shape of cross-section. Further, various shapes may be applied to the cross-section of the rubber-like member 135, in view of the bending property or the prevention of the entrance of foreign matters into the gap. Such various shapes of the deformation element 3 are shown in FIGS. 22A to 22F, for example. These deformation elements are positioned between the outer sole and the midsole at least partially at the periphery of the rear foot part.

For example, as shown in FIG. 22A, the upper plate portion 132 may be formed generally flat without the first and second upper areas inclined differently from each other. Even in this case, as shown by one-dot chain line of FIG. 22A, the upper and lower plate portion 132, 131 can rotate relative to each other.

Figure 22C:
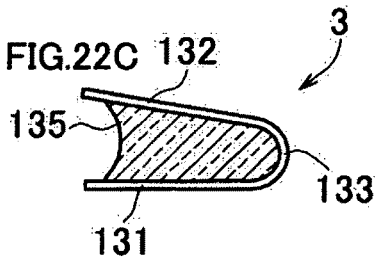
Figure 22D:
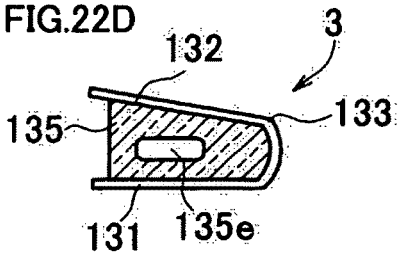

As shown in FIGS. 22C, 22D, the bending deformation member 30A may be configured so that the hinge portion 133 has a substantially smooth arc sectional shape and that the upper and lower plate portions 132, 131, which are formed generally flat, gradually get away from each other as a distance from the hinge portion 133 increases. In these figures, the rubber-like member 135 is interposed to extend up to the hinge portion 133 without clearance.

Figure 22E:
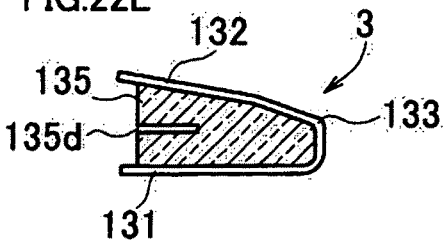

As shown in FIG. 22D, 22E, the rubber-like member 135 may have a hollow portion 135*a* or a slit 135*d*. Corner portions of the rubber-like member 135 may be rounded so that shearing deformation occurs therein.

The bending deformation member 30A may have a generally U-shaped sectional shape, i.e., the upper and lower plate portions 132, 131 may be generally parallel to each other.

As shown in FIG. 22A, the deformation element 3 includes the bending deformation member 30A, which opens toward the periphery from the center of the rear foot part. The bending deformation member 30A includes: the lower plate portion 131 that is joined to the upper surface of the outer sole; the upper plate portion 132 that is joined to the bottom surface of the midsole and that forms an opening angle with respect to the lower plate portion 131; and a curved portion 133 that connects the lower plate portion 131 and the upper plate portion 132, The lower plate portion 131, the upper plate portion 132 and the curved portion 133 are integrally formed of synthetic resin.

The upper and lower plate portions 132, 131 have respective opposed surfaces 152, 151 opposed to each other. The opposed surface 151 of the lower plate portion 131 and the opposed surface 152 of the upper plate portion 132 gradually gets away from each other as a distance from the curved portion 133 increases. A rubber-like or pod-like compression deformation member 135 is fit between the lower and upper plate portions, and the compression deformation member deforms so as to absorb energy and to store a force of restitution while being compressed.

In FIG. 22A, when a lopsided load is applied onto a position near the outer periphery of the upper plate portion 132, the upper plate portion 132 rotates about the curved portion 133. That is, the upper plate portion 132 deflects and displaces downward so that the upper plate portion 132 comes close to the lower plate portion 131. At this time, the compression deformation member 135 is compressed almost all of a range from the curved portion 133 to the opening. The upper and lower plate portions 132, 131 are arranged to form a taper sectional shape, i.e., the upper and lower plate portions 132, 131 are configured to gradually get away from each other as it gets near to the opening. Therefore, a strain (amount of deformation per pre-deformed unit height) of the compression deformation member 135 is approximately even at almost all the range from the curved portion side to the opening side.

Figure 22F:
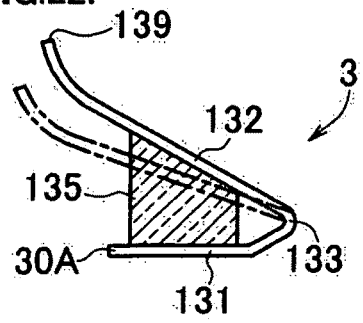
Figure 22G:
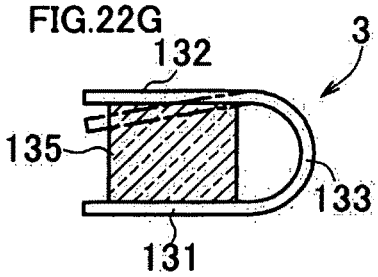
Figure 23:
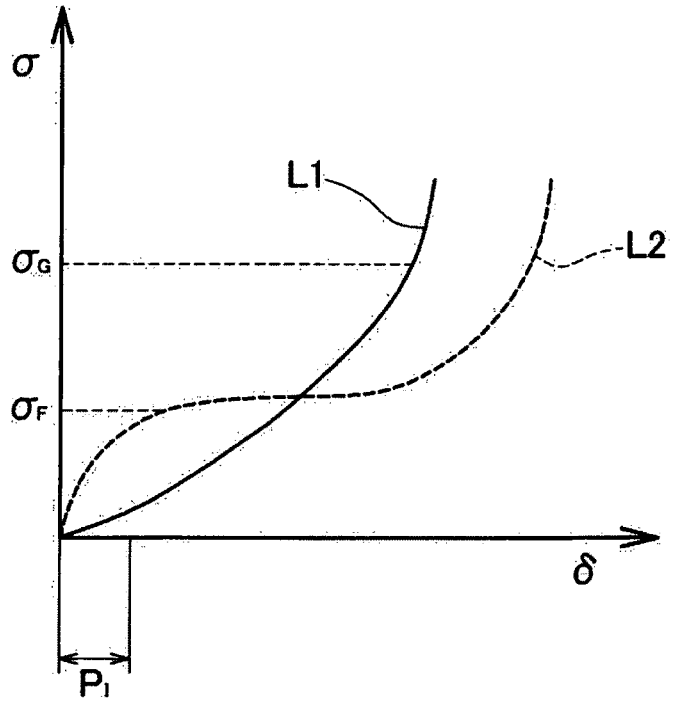
FIG. 23 is a stress-strain diagram.

On the other hand, if the upper plate portion 132 and the lower plate portion 131 are parallel to each other as shown in FIG. 22G, the strain of the compression deformation member 135 differs from the curved portion side to the opening side. That is, the strain on the opening side may be far larger than the strain on the curved portion side, and it may impair the stability of the shoe.

That is, in the case of the deformation element 3 having a U-shaped sectional shape shown in FIG. 22G, since the compression deformation member 135 has an even thickness, the strain of the compression deformation member 135 is smaller at a portion near the curved portion 133 than at a portion near the opening when a lopsided load is applied onto a position near the outer periphery (for example, when the shock of the first strike is applied). On the other hand, if the compression deformation member 135 varies in vertical thickness to form a taper as shown in FIG. 22A, the strain of the compression deformation member 135 can be the same between at the portion near the curved portion 133 and at the portion near the opening when the lopsided load is applied.

If, as shown in FIG. 22G, the bending deformation member 30A has a U-shaped sectional shape, the curved portion 133 would displace in the horizontal direction when being compressed vertically. This displacement may cause a difficulty of the junction between the bending deformation member 30A and the midsole. On the other hand, if, as shown in FIG. 22A, the bending deformation member 30A has a generally V-shaped sectional shape, the lower and upper plate portions 132, 131 displace or deflect in such a manner as to rotate relative to each other about the curved portion, whereby a force of restitution is stored in the bending deformation member 30A. That is, the upper and lower plate portions 132, 131 displace vertically so as to get close to each other without much displacement of the curved portion. Therefore, the bending deformation member 30A and the midsole can be easily joined to each other.

Further, since the compression deformation member 135 is formed in a taper shape, a displacement or inclination of the foot toward the periphery of the foot can be restrained, thereby increasing the stability of the support for the foot.

Further, since the upper and lower plate portions 132, 131 are arranged so as to form a taper sectional shape, it becomes easy to remove a mold or a die at the time of molding the bending deformation member.

In the deformation element show in FIG. 22F, a roll-up portion 139 is integrally formed with the bending deformation member 30A to be continuous with the upper plate portion 132. At the time of the bending deformation, the deflection of the bending deformation member 30A sharply increases toward the tip of the roll-up portion 139. Therefore, the roll-up portion 139 makes it easy to support a load transferred from the midsole with the bending deformation member at the periphery of the foot.

Another shock absorbing device for a shoe sole according to this embodiment, the deformation elements are positioned at the periphery of the rear foot part. The deformation element includes the bending deformation member that opens toward the periphery from the center of the rear foot part, and the bending deformation member is generally V-shaped or U-shaped in section. The bending deformation member includes: a lower plate portion that is joined to the top surface of the outer sole; an upper plate portion that is joined to the bottom surface of the midsole, and a hinge portion that connects the lower plate portion and the upper plate portion. The lower and upper plate portions and the curved portion are integrally formed of synthetic resin. A rubber-like or pod-like compression deformation member is fit between the lower and upper plate portions, and the compression deformation member deforms so as to store a force of restitution while being compressed.

The bending deformation member is provided at least at a region from one side of the medial side and the lateral side of the rear foot part to the rear end of the rear foot part. The lower plate portion is divided separately in the longitudinal direction at the region between the one side and the rear end.

If the bending deformation member is provided continuously and seamlessly from the medial or lateral side of the rear foot part up to the rear end of the rear foot part, the smooth motion where the sole of the foot gradually gets contact with the ground after the rear end of the rear foot part lands on the ground may be impossible.

On the other hand, in the bending deformation member of this shock absorbing device, the lower plate portion is divided separately. Therefore, the deformation according to the region of the foot can be easily realized and the motion of the foot during the period from the landing of the rear end of the rear foot part to the forward bending of the foot can be smoothly done.

In this shoe sole, preferably, a connecting member for connecting the midsole and the bending deformation member is interposed between the midsole and the bending deformation member. In this case, Young's modulus of the material forming the connecting member is larger than that of the material forming the midsole and smaller than that of the material forming the bending deformation member.

In this shoe sole, the shock of landing is dispersed by the relatively hard bending deformation member and more dispersed by the relatively soft connecting member. Thus, the function of dispersing the shock can be enhanced, and a soft sensation on the sole of the foot can be produced.

In the fifth embodiment, the bending deformation member may be directly joined to the midsole or another member may be interposed between the bending deformation member and the outer sole. The midsole may be divided vertically or longitudinally. The deformation elements may be disposed only one of the medial and lateral side. The deformation element may be provided at a fore foot part in addition to the rear foot part. The notch of the deformation elements need not necessarily be provided. The number of the rubber-like members is not limited to three, and four or more separate lower plate portions and four or more separate rubber-like members may be provided in the rear foot part. The through holes of the upper plate portion and the upper and inner protrusions of the rubber-like member need not necessarily be provided, and the rubber-like member may be supported merely by being sandwiched by the bending deformation member.

While preferred embodiments of the present invention have been described above with reference to the drawings, obvious variations and modifications will readily occur to those skilled in the art upon reading the present specification.

Figure 10:
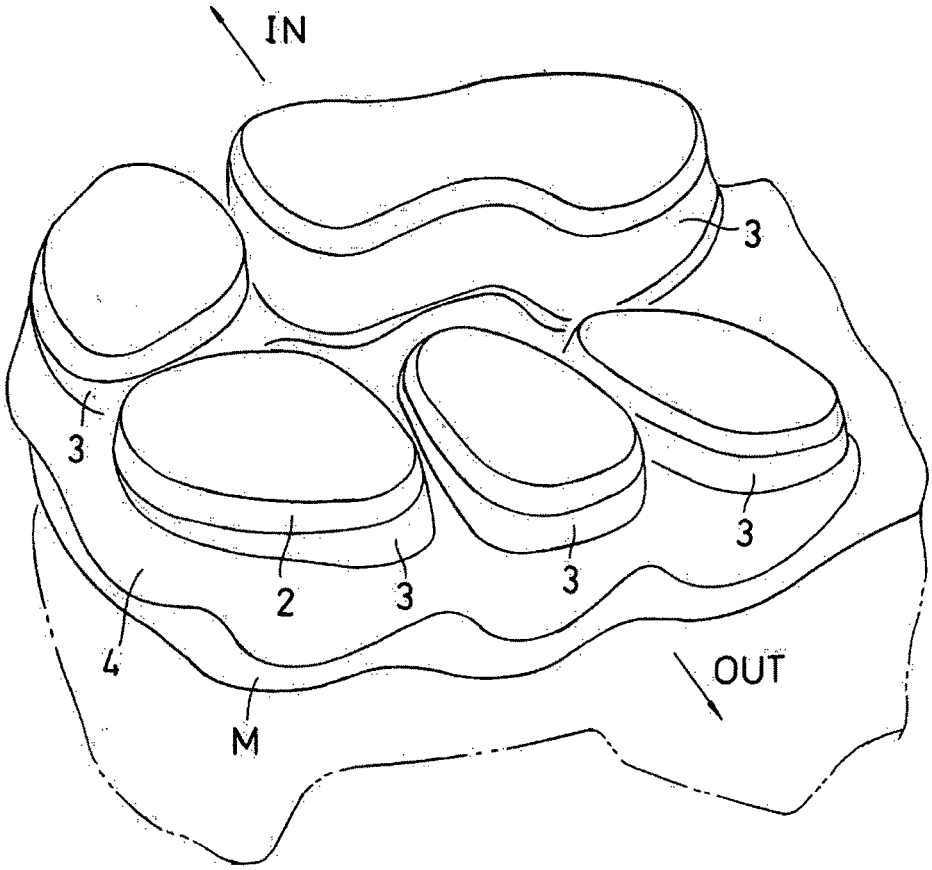
FIG. 10 is a perspective view of a shoe according to a modified embodiment viewed from the bottom side.

For example, although, in the above embodiments, three or four deformation elements are provided, five deformation elements may be provided as shown in FIG. 10. In this case, three of them are arranged separately on the lateral side of the rear foot part and the other two of them are arranged separately on the medial side of the rear foot part. Six or more deformation elements may be provided in the rear foot part.

The support element need not necessarily be the midsole of resin foam. For example, a support plate of non-foam resin disclosed in Japanese Patent Laid Open No. 09-285304 may be utilized as the support element.

Thus, such variations and modifications shall fall within the scope of the present invention as defined by the appended claims.

INDUSTRIAL APPLICABILITY

The present invention is applicable to shoe soles of various shoes such as athletic shoes.

The invention claimed is:

1. A shock absorbing device for a shoe sole in a rear foot part comprising:

a support element that supports at least whole of a rear foot part of a foot, the support element having a function of absorbing a shock of landing;

deformation elements disposed below the support element in the rear foot part, the deformation elements deforming to be compressed vertically at landing; and outer sole elements contacting a ground at landing, each outer sole element being joined to a bottom surface of the respective deformation element, wherein both the deformation elements and the outer sole elements are substantially separated at least in a medial-lateral direction in the rear foot part to be arranged at least three regions of the rear foot part, a vertical compressive stiffness of the deformation element disposed on a lateral side of the rear foot part is smaller than that of the deformation element disposed on a medial side of the rear foot part.

2. A shock absorbing device for a shoe sole in a rear foot part according to claim 1, wherein:

the deformation elements are arranged in respective regions of the at least three regions; and an average of vertical compressive stiffness per unit area of the deformation elements disposed on the lateral side of the rear foot part is smaller than that of the deformation elements disposed on the medial side of the rear foot part.

3. A shock absorbing device for a shoe sole in a rear foot part according to claim 1, wherein the support element includes a first roll-up portion rolling upwards along a side face from a bottom face of the foot, each deformation element includes a material having larger Young's modulus than the material forming the support element, and the material having the larger Young's modulus constitute a third roll-up portion rolling upwards outside the first roll-up portion of the support element.

4. A shock absorbing device for a shoe sole in a rear foot part according to claim 1, wherein in at least one of the regions, the deformation element is more difficult to compress vertically in medial and lateral side portions than in a central portion in the medial-lateral direction.

5. A shock absorbing device for a shoe sole in a rear foot part according to claim 1, wherein the deformation elements are arranged to be substantially separated in the longitudinal direction in the rear foot part of a foot, the deformation elements include: a first deformation element disposed at a rear end of the rear foot part; a second deformation element disposed forward of the first deformation element on a lateral side of the rear foot part; and a third deformation element disposed forward of the first deformation element on a medial side of the rear foot part, a vertical compressive stiffness of the third deformation element is larger than that of the first deformation element and larger than that of the second deformation element.

6. A shock absorbing device for a shoe sole in a rear foot part comprising a support element that supports at least whole of a rear foot part of a foot, the support element having a function of absorbing a shock of landing;

deformation elements disposed below the support element in the rear foot part, the deformation elements deforming to be compressed vertically at landing; and outer sole elements contacting a ground at landing, each outer sole element being joined to a bottom surface of the respective deformation element, wherein both the deformation elements and the outer sole elements are substantially separated in a medial-lateral direction and/or a longitudinal direction in the rear foot part to be arranged at least three regions of the rear foot part.

7. A shock absorbing device for a shoe sole in a rear foot part comprising:

a support element that supports at least whole of a rear foot part of a foot, the support element having a function of absorbing a shock of landing;

deformation elements disposed below the support element in the rear foot part, the deformation elements deforming to be compressed vertically at landing; and outer sole elements contacting a ground at landing, each outer sole element being joined to a bottom surface of the respective deformation element, wherein the deformation elements include: a first deformation element disposed at a rear end of the rear foot part; a second deformation element disposed forward of the first deformation element on a lateral side of the rear foot part; and a third deformation element disposed forward of the first deformation element on a medial side of the rear foot part, the first, second and third deformation elements each has a predetermined height, forming a depressed area surrounded by the first deformation element in a medial side of the depressed area, the second deformation element in a lateral side of the depressed area, and the third deformation element in a rearward of the depressed area, a first groove comparting the first deformation element and the second deformation element and extending from the depressed area to an outer circumferential edge of the rear foot part is formed between the first and second deformation elements, a second groove comparting the first deformation element and the third deformation element and extending from the depressed area to the outer circumferential edge of the rear foot part is formed between the first and third deformation elements.

8. A shock absorbing device for a shoe sole in a rear foot part according to claim 7, wherein a length of the third deformation element in the medial side is longer, in a longitudinal direction of the foot, than a length of the second deformation element in the lateral side.

9. A shock absorbing device for a shoe sole in a rear foot part according to claim 8, wherein a first opening portion that the first groove opens in the outer circumferential edge is located anterior to a second opening portion that the second groove opens in the outer circumferential edge.

10. A shock absorbing device for a shoe sole in a rear foot part according to claim 9, wherein a rear end of the first opening portion is located anterior to a front end of the second opening portion.

11. A shock absorbing device for a shoe sole in a rear foot part according to claim 7, wherein the third deformation element is continuous from the second groove to a front end of the rear foot part, the second deformation element is provided between the first groove and the front end of the rear foot part, and a third groove extending from the depressed area toward a lateral edge of the foot is formed on the second deformation element.

12. A shock absorbing device for a shoe sole in a rear foot part according to claim 7, wherein further comprising a connecting member that is interposed between the support element and the deformation elements, the connecting member being joined to the bottom surface of the support element and joined to an upper surface of each deformation element, wherein Young's modulus of a material forming the connecting member is larger than that of the material forming the support element.

13. A shock absorbing device for a shoe sole in a rear foot part according to claim 12, wherein the support element includes a first roll-up portion rolling upwards along a side face from a bottom face of the foot, and the connecting member includes a second roll-up portion rolling upwards outside the first roll-up portion of the support element.

* * * * *